US007100911B2

(12) United States Patent
Middelberg et al.

(10) Patent No.: US 7,100,911 B2
(45) Date of Patent: Sep. 5, 2006

(54) METHOD AND APPARATUS FOR ASSEMBLING A STACK OF SHEET ARTICLES FROM MULTIPLE INPUT PATHS

(75) Inventors: Neal J. Middelberg, Apex, NC (US); Gerard A. DeRome, Jr., Cary, NC (US); Dale R. Curry, Apex, NC (US)

(73) Assignee: Bowe Bell + Howell Company, Durham, NC (US)

( * ) Notice: Subject to any disclaimer, the term of this patent is extended or adjusted under 35 U.S.C. 154(b) by 82 days.

(21) Appl. No.: 10/359,928

(22) Filed: Feb. 6, 2003

(65) Prior Publication Data

US 2003/0146559 A1 Aug. 7, 2003

Related U.S. Application Data

(60) Provisional application No. 60/355,565, filed on Feb. 7, 2002.

(51) Int. Cl.
*B65H 29/34* (2006.01)

(52) U.S. Cl. ..... 271/9.01; 271/189; 270/58.23; 270/58.01; 270/52.02

(58) Field of Classification Search ..... 271/9.01, 271/9.11, 9.13, 189; 270/58.23, 58.24, 58.25, 270/58.01, 52.02
See application file for complete search history.

(56) References Cited

U.S. PATENT DOCUMENTS 4,084,464 A 4/1978 Bowers
4,295,733 A * 10/1981 Janssen et al. ..... 399/403
4,674,375 A 6/1987 Golicz
4,873,547 A 10/1989 Sasaki et al.
5,053,955 A 10/1991 Peach et al.
5,085,470 A 2/1992 Peach et al.
5,203,551 A 4/1993 Lowell et al.
5,297,783 A 3/1994 Howard et al.
5,321,604 A 6/1994 Peach et al.
5,413,326 A 5/1995 Wright
5,462,399 A 10/1995 Clupper et al.
5,570,172 A 10/1996 Acquaviva
5,575,465 A 11/1996 Auerbach et al.
5,604,600 A 2/1997 Webster
5,617,215 A 4/1997 Webster et al.
5,646,740 A 7/1997 Webster et al.
5,649,698 A 7/1997 Auerbach et al.
5,682,247 A 10/1997 Webster et al.
5,699,493 A 12/1997 Davidson, Jr. et al.
5,704,604 A * 1/1998 Koelle et al. ..... 270/52.09

(Continued)

FOREIGN PATENT DOCUMENTS

CH 665 169 A5 4/1988

*Primary Examiner*—Patrick H. Mackey
(74) *Attorney, Agent, or Firm*—McDermott Will & Emery LLP

(57) ABSTRACT

An apparatus for assembling a plurality of sheet articles into a document includes a plurality of individual sheet input paths along which one or more sheet articles can be advanced, and a central accumulation area for accumulating the sheet articles. The central accumulation area includes a single-level accumulation surface for receiving one or more sheet articles advanced from each individual sheet input path and accumulating the sheet articles in a single stack. The central accumulation area can receive sheet articles from two or more different directions. The sheet articles can optionally be staged for accumulation into subsets prior to advancement to the central accumulation area. The central accumulation area advances the assembled document into an output path.

33 Claims, 16 Drawing Sheets

U.S. PATENT DOCUMENTS 5,710,635 A 1/1998 Webster et al.
5,727,781 A 3/1998 Muller
5,732,939 A 3/1998 Meier
5,746,568 A 5/1998 Ogawa et al.
5,810,346 A 9/1998 Jörg
5,913,656 A * 6/1999 Collins ..... 414/801
5,947,461 A 9/1999 Holbrock
6,025,925 A 2/2000 Davidson, Jr. et al.
6,026,143 A 2/2000 Simanovsky et al.
6,076,400 A 6/2000 Bechwati et al.
6,108,396 A 8/2000 Bechwati et al.
6,128,365 A 10/2000 Bechwati et al.
6,161,828 A 12/2000 Sussmeier
6,164,640 A 12/2000 Stengl et al.
6,189,880 B1 * 2/2001 Besold ..... 270/58.25
6,189,889 B1 * 2/2001 Yip ..... 273/348
6,224,048 B1 * 5/2001 Motamed ..... 270/52.02
6,244,584 B1 6/2001 Holbrook et al.
6,467,763 B1 * 10/2002 Depoi et al. ..... 270/52.09

* cited by examiner

METHOD AND APPARATUS FOR ASSEMBLING A STACK OF SHEET ARTICLES FROM MULTIPLE INPUT PATHS

RELATED APPLICATIONS

This application claims the benefit of U.S. Provisional Patent Application Ser. No. 60/355,565, filed Feb. 7, 2002, the disclosure of which is incorporated herein by reference in its entirety.

TECHNICAL FIELD

The disclosed subject matter generally relates to the processing of sheet articles. More particularly, the disclosed subject matter relates to the assembly of documents in a central merge or accumulation location from multiple input paths through which streams of sheet articles are transported.

BACKGROUND ART

Documents such as booklets, packets, and the like often consist of subsets of printed sheet material that are bound together by perfect binding or other finishing techniques. The various subsets comprising each document can contain one or more units of sheet material. The subsets are often supplied from different sources such as color printers, black and white printers, and offset printers. Each subset might have been printed at a different time and place, so that the subsections must be subsequently merged to form a complete document. In order to assemble a large volume of documents, each containing multiple subsets of sheet material, multiple print streams must be merged. The merging of multiple print streams is typically done manually, and accordingly can be time consuming, create health problems due to repetitive motion, and result in an unacceptable rate of integrity defects due to human error. These and other problems can be more acute in processing jobs where each document, while containing the same types of subsets, is personalized such that one or more of the subsets includes information specific to the individual intended to receive that document.

Accordingly, the desirability of automating the process of merging multiple sheet streams is well recognized within the industry. As a general matter, the merging of sheet materials can be performed by collating machines, but conventional collators are not optimized for assembling a series of personalized documents from multiple input streams. Typical collators are capable of accumulating only single sheets. Moreover, typical collators are order-dependent, meaning that their input streams are fixed such that the accumulation or collating process cannot be modified or randomized. In addition, the scrap cost associated with conventional collators is unacceptably high due to the required use of separator sheets. Separator sheets are used to mark or identify each subset of sheet material within the stack comprising a complete document. Such separator sheets are typically discarded upon completion of the document, and in any event do not add value to the information provided by the document.

An example of a system for collating multiple incoming sheet streams is disclosed in U.S. Pat. No. 5,462,399. Like other conventional collators, the disclosed system is order-dependent. The system includes three input devices oriented at right angles to each other. Each input device feeds sheets into a centrally located collating device. The collating device is constructed from a stack of three vertically spaced trays. Each input device is limited to feeding its corresponding sheets into a specific one of these trays. Thus, after each input device has been operated, the collating device contains three separate stacks of sheets and hence does not itself truly merge the three input streams. A kicker arm, spanning the height of the entire collator, is then activated to push the stacks of all three levels into an exit device. Due to the configuration of the three-level collator, three distinct sets of sheets are maintained after being supplied from the three input devices. The disclosed system therefore cannot be randomized with respect to the relative order in which sheets enter the collator from multiple directions.

SUMMARY

A novel apparatus and method for assembling a stack of sheet articles from multiple input paths is disclosed herein. In a preferred embodiment, at least three different sheet paths are utilized, and the assembled sheet stack is advanced downstream for subsequent processing.

The apparatus and method disclosed herein are suitable for use with sheet articles advanced in a stream along input paths such as those from a color printer, black and white printer, or from offset printed material, and also from those applications where material has been printed at a different time or place. These different streams of items can be automatically be selectively used to assemble a stacked document of sheet articles which can be advanced or routed to any downstream device. Furthermore, read technology can be utilized on each of the input paths processing the different sheet streams and thus separator sheets are not required, saving on material and disposal costs. Finally, as opposed to prior art collators that accumulate single sheets and are order-dependent, the apparatus can process different sets of sheets, which can be fed in mixed order.

The apparatus and method in one embodiment include providing sheet article input paths for sheet articles on three sides of a central accumulation area, such as one upstream input path and two side-stream input paths, and an output path on the fourth side of the central accumulation area. A variety of input path-related structures, devices, modules, and the like can be used as desired to advance sheet articles from different sheet streams into the central accumulation area, and the output mechanism or device can be angled to facilitate the exit of the assembled stack or document of sheet articles to downstream devices. The incoming or input sheet articles are accumulated in the central accumulation area, preferably in an over-accumulation manner, in proper sequence as can be directed by code data printed on the sheet material, such as for example job or read marks. Each input path can have read capability and can be a free-flowing, transport type input path, or can be a staged input path wherein a single sheet or set of sheets can be stopped or staged and even accumulated for a desired amount of time prior to advancement of the sheet articles into the central accumulation area. By having the inputs staged, system throughput can be optimized and jam removal and data reconciliation can be simplified, as can be appreciated by those of skill in the art.

Each input path can be adjustable so as to handle a full range of paper, including both landscape and portrait formats. If sheet articles from the side-stream input paths are transported into the central accumulation area in landscape format, then the orientation of the sheet articles when outputted will be portrait and vice-versa. Sheet articles that have been merged and accumulated in a stack in the central accumulation area can all be of the same approximate size and can be registered in all three dimensions to ensure a square stack upon exit. The stack of accumulated sheet articles can be either centerline or right edge justified, depending on the downstream device requirements. Additionally, each subsequent set or stack of accumulated sheet articles can be registered to alternating sides, making it easier to singulate the output. The accumulated stack in the central accumulation area can then be discharged through the output path and advanced for downstream processing. Any suitable mechanism can be used for advancing the accumulated sheet stack from the central accumulation area, such as, for example, push pins on a conveyor system and/or output path nip rollers. Preferably, a shuttle plate is employed as described herein.

According to one embodiment, an apparatus for assembling a stack of sheet articles comprises a plurality of individual sheet input paths along which one or more sheet articles can be advanced, a central accumulation area for accumulating one or more sheet articles, and an output path for advancing an assembled sheet stack from the central accumulation area. The central accumulation area comprises a single-level accumulation surface for receiving one or more sheet articles advanced from each individual sheet input path and assembling the sheet articles in a single stack.

In a method for merging multiple sheet streams, one or more sheet articles are advanced along each of a plurality of individual sheet paths. The sheet articles are advanced from each of the individual sheet paths into a central accumulation area where the sheet articles are assembled into a single sheet stack at a single elevation. The sheet stack is then advanced out of the central accumulation area into an output path.

It is therefore an object to provide a novel apparatus and method for assembling a stack of sheet articles from multiple input sources.

An object having been stated hereinabove, and which is achieved in whole or in part by the apparatus and method disclosed herein, other objects will become evident as the description proceeds when taken in connection with the accompanying drawings as best described hereinbelow.

DETAILED DESCRIPTION

As used herein, the term "sheet article unit" generally refers to a single sheet of material, such as a folder or unfolded sheet of paper, or an envelope, a folder or any suitable type of insert for such units. The term "set" or "subset" generally refers to more than one sheet article unit. For example, a subset can be formed by accumulating a stream of individual sheet article units into a stack of sheet material. The term "sheet article" generally refers to one or more sheet article units, and therefore encompasses both the terms "sheet article unit" and "set" or "subset". The term "document" generally refers to a stack of one or more sheet articles, with the stack being assembled by means of accumulation, collation, or merging. The sheet articles to be assembled into a document can relate to or be associated with each other in any desired manner. For instance, a given document can comprise a combination of sheet articles, all of which are intended to be provided to the same designated recipient. Non-limiting examples of documents include booklets, itineraries, invoices, and the like. Depending on the job to be processed, each document could be personalized for its intended recipient.

Figure 1:
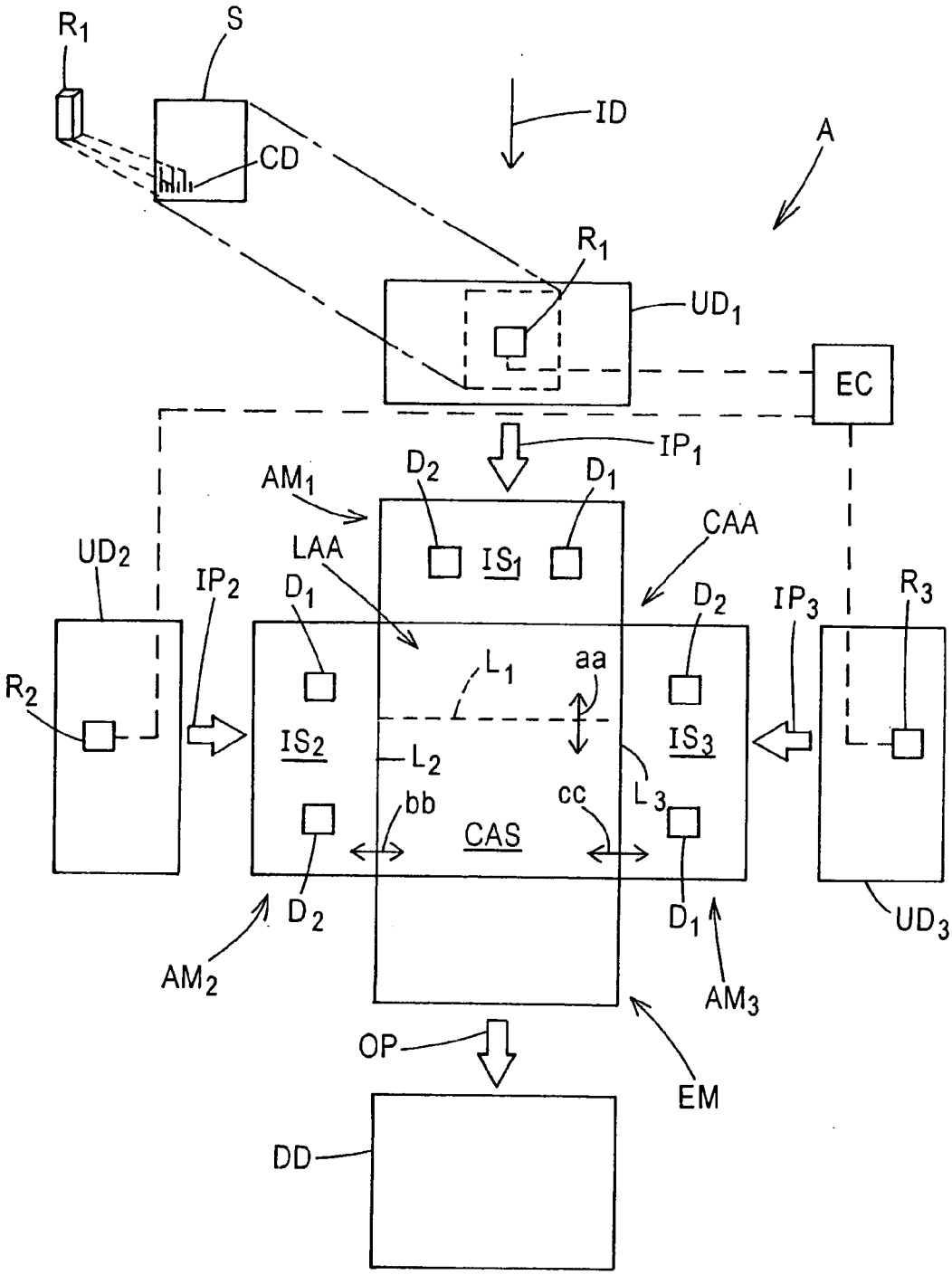
FIG. 1 is a schematic, top plan view of a merge apparatus and method.

Referring now to FIG. 1, a top plan view of an apparatus for assembling a stack of sheet articles, generally designated as assembling apparatus A, is schematically illustrated according to an embodiment. Assembling apparatus A comprises a central accumulation area, generally designated CAA; first, second, and third sheet input paths, $IP_1$, $IP_2$ and $IP_3$ respectively; and a sheet output path OP. First, second, and third input paths $IP_1$, $IP_2$ and $IP_3$ comprise components suitable for transporting respective first, second, and third input streams of sheet articles from respective first, second and third upstream devices $UD_1$, $UD_2$ and $UD_3$ to central accumulation area CAA. In FIG. 1, first, second and third upstream devices $UD_1$, $UD_2$ and $UD_3$ can represent any number of different types of upstream devices, components, and sources commonly employed in sheet article processing applications, such as hoppers, cutters, feeders, bursters, printers, two-up rolls, sheet stacks, conveyors, and combinations thereof. Output path OP comprises an exit module, generally designated EM, an example of which is described below, which is suitable for receiving assembled documents from central accumulation area CAA and transporting documents toward one or more downstream devices DD, components, or the like. By way of example, downstream devices DD can include folders, perfect binders, booklet makers, stuffers for envelopes and pocket folders, polywrappers, inserters, diverters, conveyors, receptacles, and/or AIM (automated in-line mailing) sections.

First sheet input path $IP_1$ and output path OP are disposed on opposite longitudinal ends of central accumulation area CAA, such that first input path $IP_1$, feeds sheet articles into central accumulation area CAA generally along the same direction as central accumulation area CAA feeds assembled documents into output path OP. Accordingly, first input path $IP_1$ and output path OP transport sheet articles along an in-line direction ID of merge apparatus MA, and first input path $IP_1$ can be referred to as the in-line path of assembling apparatus A. Second and third sheet input paths $IP_2$ and $IP_3$ are disposed on opposite lateral sides of central accumulation area CAA, such that second and third input paths $IP_2$ and $IP_3$ feed sheet articles into central accumulation area CAA generally along directions orthogonal or oblique (not specifically shown) directions relative to in-line direction ID.

Depending on the requirements of assembling apparatus A for a given job, one or more of first, second and third sheet input paths $IP_1$, $IP_2$ and $IP_3$ can be operational. Moreover, from any given sheet input path IP, central accumulation area CAA is capable of receiving a series of either single sheet articles or subsets of two or more sheet articles. Therefore, as used herein, the term "sheet article" refers either to a single unit of sheet material, such as one page of a multi-page document to be assembled in central accumulation area CAA, or to a plurality of sheet material units that have been accumulated into a subset prior to entry into central accumulation area CAA.

Each of first, second and third sheet input paths $IP_1$, $IP_2$ and $IP_3$, can comprise respective first, second and third accumulator modules, generally designated $AM_1$, $AM_2$ and $AM_3$, for which structural details are described below. Each accumulator module $AM_1$, $AM_2$ and $AM_3$ can be set to transport single sheet articles or subsets of sheet articles from its respective upstream device $UD_1$, $UD_2$ and $UD_3$, along a respective input surface $IS_1$, and $IS_2$ and $IS_3$, and into central accumulation area CAA. Additionally, each accumulator module $AM_1$, $AM_2$ and $AM_3$ can receive a stream of sheet article units, accumulate the units into a subset, and subsequently transfer the subset into central accumulation area CAA.

As described below, each accumulator module $AM_1$, $AM_2$ and $AM_3$ includes means for staging one or more sheet articles for a predetermined period of time while other sheet articles are being fed from one or more of the other input sheet streams. Depending on the specific implementation selected for assembling apparatus A, any combination of first, second and third input paths $IP_1$, $IP_2$ and $IP_3$ of assembling apparatus A can include accumulator modules AM that interface with central accumulation area CAA. For example, sheet articles of first input path $IP_1$ might be fed into central accumulation area CAA directly from first upstream devices $UD_1$ (without the use of a first accumulator module $AM_1$), while side (second and third) accumulator modules $AM_2$ and $AM_3$ are in fact provided for accumulating, staging and feeding sheet articles into central accumulation area CAA. In another example, only one of input paths $IP_1$, $IP_2$ and $IP_3$ includes an accumulator module $AM_1$, $AM_2$ and $AM_3$ interfacing with central accumulation area CAA.

As described in more detail below, central accumulation area CAA in one advantageous embodiment comprises a single or single-level central sheet accumulation surface CAS, disposed at a single level or elevation, for receiving sheet articles fed from all input paths $IP_1$, $IP_2$ and $IP_3$. This configuration imparts a unique flexibility to the operation of assembling apparatus A, because sheet articles can be fed to the same accumulation surface CAS from any direction and in any order desired for the particular job. Preferably, the elevation of central accumulation surface CAS is lower than the respective elevations of first, second and third input paths $IP_1$, $IP_2$ and $IP_3$, at least at the interfaces of their respective input surfaces $IS_1$, $IS_2$ and $IS_3$ with central accumulation surface CAS. As described below, this lower-elevation accumulation surface CAS is structured as a center pocket for this purpose. Documents are thus preferably assembled in central accumulation area CAA by over-accumulation.

Another feature adding to functional flexibility is that assembling apparatus A is adjustable to accommodate a change in form size of sheet articles to be processed from job to job. For example, for a given job, assembling apparatus A can be set to assemble a document consisting of standard letter-size sheet articles, and for another subsequent job can be reset to assemble a document consisting of A4-size sheet articles. For this purpose, assembling apparatus A comprises a longitudinal adjustment assembly, generally designated LAA, mounted in an upstream region of central accumulation area CAA, for adjusting the longitudinal or in-line length of accumulation surface CAS. Preferably, longitudinal adjustment assembly LAA also operates to feed sheet articles into central accumulation area CAA from first input path $IP_1$. Also, side (second and third) accumulator modules $AM_2$ and $AM_3$, and particularly their structural interfaces with central accumulation area CAA, are laterally adjustable relative to central accumulation area CAA so as to change the lateral width of central accumulation surface CAS. Thus, in FIG. 1, central accumulation area CAA is conceptually partitioned by a broken line $L_1$ into an upstream area at which longitudinal adjustment assembly LAA is situated and a downstream area at which central accumulation surface CAS is operative to receive sheet articles. The interface between longitudinal adjustment assembly LAA and central accumulation surface CAS, i.e., broken line $L_1$, is thus movable along arrow aa. The interfaces between side accumulator modules $AM_2$ and $AM_3$ and central accumulation surface CAS, represented by solid lines $L_2$ and $L_3$, respectively, are movable along arrows bb and cc. The details of these adjustment features are described below.

As further schematically shown in FIG. 1, each accumulator module AM can include one or more sheet detection devices $D_1$ and $D_2$, such as photocells or other suitable means, for monitoring the flow of sheet articles in the corresponding input stream. For example, in each accumulator module AM, one detection device $D_1$ can be employed to detect the presence of a sheet article in accumulator module AM, and another detection device $D_2$ can be employed to count sheet articles as they are fed into or from accumulators module AM. As appreciated by persons skilled in the art, sheet detection devices $D_1$ and $D_2$ in the form of photocells are appropriately mounted above the surface over which sheet articles are transported, and direct a light beam downwardly toward a reflective component mounted at such surface. As appreciated by persons skilled the art, detection devices D, and $D_2$ can provide electrical feedback for any suitable, appropriately programmed central or local electronic processing unit EC or microcontroller provided with assembling apparatus A, such as a microprocessor or other suitable means for executing instructions.

In another advantageous embodiment, each input path $IP_1$, $IP_2$ and $IP_3$ can include a respective reader device $R_1$, $R_2$ and $R_3$ for reading code data that is printed on each sheet article to be processed by assembling apparatus A, and for generating electrical signals indicative of and/or responsive to the data read from a given sheet article. By way of example, the inset of FIG. 1 illustrates reader device $R_1$ of first input path $IP_1$ reading code data CD from a sheet article unit S. Code data CD can be positioned in any suitable location on sheet article unit S and can include any suitable readable data for feeding or processing instructions.

As can be appreciated by persons skilled in the art, each reader R can be interfaced through suitable circuitry or bus architectures with electronic processing unit EC. As known in the art, the microcontroller comprising or included with electronic processing unit EC can be a microprocessor, a digital signal processor, programmable logic device (PLD) or other programmable device, implemented either as a general purpose device or as an application-specific integrated (ASIC) chip. The microcontroller typically includes a programmable central processing unit (CPU) and associated bi-directionally and/or uni-directionally coupled memories. Non-limiting examples of memories include random access memory (RAM), cache memory or other dynamic storage device for data, and read-only memory (ROM) and/or electrically erasable read-only memory (EEPROM) for program storage. Memory can comprise removable or fixed mass storage devices. Examples of removable storage devices include computer-readable media (magnetic, optical, magnetooptical, etc.) such as CD-ROM, CD-R, CD-RW, floppy disks, magnetic tape, flash memory, signals embodied on a carrier wave, PC-CARDS, portable mass storage devices, and holographic storage devices. Fixed storage devices typically are provided in the form of hard disk drives. Electronic processing unit EC can be interfaced as appropriate with any of the various types of available input devices (e.g., keyboard, keypad, pointing device, touch-sensitive display screen, microphone, voice or handwriting recognizer, or the like), output devices (e.g., display monitor, sound card, speaker, or the like), and network interfaces (which could be wireless), all of which could implemented using suitable cards and software as appropriate.

The CPU can be implemented by a single-chip processor or by multiple processors as necessary to control the operation of electronic processing unit EC in accordance with the embodiments herein. For instance, the CPU can, if needed, utilize instructions retrieved from memory to control the reception and manipulation of input data and the output and display of data on output devices. Data used by electronic processing unit EC can include data objects and/or text objects. In accordance with the embodiments herein, the microcode, objects, or the like stored in the memory can include programming for the processing of signals received from electrical components such as reader R and detection devices $D_1$ and $D_2$. Content stored or loaded into memory can include one or more databases, registers, look-up tables, data structures, and the like containing information characterizing the documents to be assembled by assembling apparatus A for a given job, as well as characterizing the sheet articles to be used in assembling the documents. The content can also include any distinguishing information that personalizes each document to be assembled in accordance with the job.

Electronic processor EC can be used to compare the information representing code data CD read by readers R with the information stored or loaded in memory. Code data CD can include a document identifier for associating sheet article unit S with a specific document job, and for associating sheet article unit S with a specific input path IP. Reader R can sequentially read the document identifier printed on each sheet article unit S to confirm that the document identifier for that particular sheet article unit S corresponds to the current document job being processed and/or input path IP in which sheet article unit S is being processed. If, for example, the document identifier does not correspond to the current document job, the sheet-movement devices of the input path IP with which reader R is associated can be stopped for correction. The other input paths IP, however, can continue to operate if appropriate. Code data CD can also include a subset identifier for associating sheet article unit S with a specific subset of the document being processed in the corresponding input path IP. For example, the local or central electronic processing unit, which can be any suitable control unit, such as for example an electronic controller EC (FIG. 1) which can be a microprocessor, can be programmed for a given job such that each document assembled in central accumulation area CAA is to receive a subset from first input path $IP_1$ consisting of three sheet article units S, a subset from second input path $IP_2$ consisting of four sheet article units S, and a subset from third input path $IP_3$ consisting of five sheet article units S. If reader $R_1$ of first input $IP_1$ path detects that a fourth sheet article unit S is being transported toward first accumulator module $AM_1$ or central accumulation area CAA, an error flag can be generated and first input path $IP_1$ shut down.

Moreover, readers $R_1$, $R_2$ and $R_3$ and their associated input paths $IP_1$, $IP_2$ and $IP_3$ are capable of accommodating document jobs in which each document is personalized. For example, in a given job, the number of sheet article units S constituting the subset processed by one or more of input paths $IP_1$, $IP_2$ and $IP_3$ might vary from one personalized document to another. In order to handle variable-sheet-count subsets, the code data CD of the last sheet article unit S of each subset can include an end-of-subset (EOS) character readable by reader R. During assembly of a document during a given job, after the reader R of any input path IP has read an EOS character, reader R can generate an error flag if it then detects a sheet being fed after the EOS character-containing sheet article unit S.

Typically, reader devices R are optical devices. A non-limiting example of a suitable reader device R is MICROSCAN® scanner commercially available from Microscan Systems, Inc., Renton, Wash., as model MS-911. However, reader device R can be any suitable reader or scanner, and thus code data CD can comprise any number of different types of known or later developed symbologies or characters sets. Non-limiting examples include coded information commonly known as Data Matrix, Data Glyph, Bar Code 39, OCR, Post Net barcode, Planet Code, Interleaved 2 of 5, and PDF 417. Each reader device R is mounted in relation to its corresponding input path IP so as to be able to read the code data CD of each sheet article unit S passing therethrough. Accordingly, each reader device R is typically mounted upstream of any accumulator module AM present in input path IP rather than directly at the accumulator module AM, particularly if it is contemplated that one or more of accumulator modules AM will receive pre-accumulated subsets of sheets in certain jobs. Assembling apparatus A can be configured such that all reader devices R electrically communicate with electronic processor EC, which as described above can be a microprocessor-based device such as a computer, programmable logic controller, or the like. The output from each reader device R is typically used to control only the input stream to which that particular reader device R is dedicated, although it is envisioned that the output from each reader R could be used for any suitable purpose as can be appreciated by those of skill in the art.

Figure 2A:
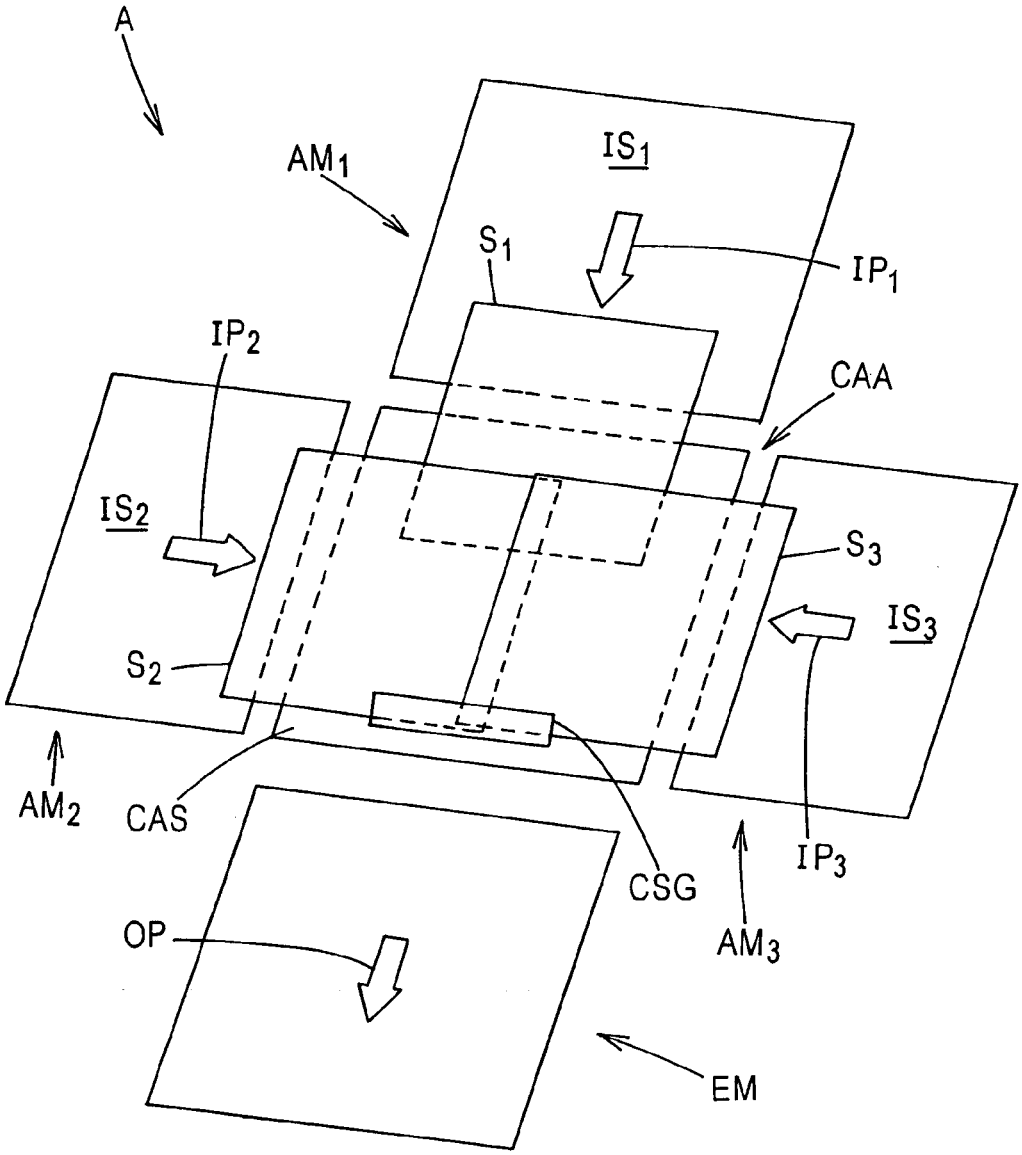
FIG. 2A is a schematic, top plan view of the apparatus and method disclosed herein, illustrating sheet articles being sequentially fed from multiple directions.
Figure 2B:
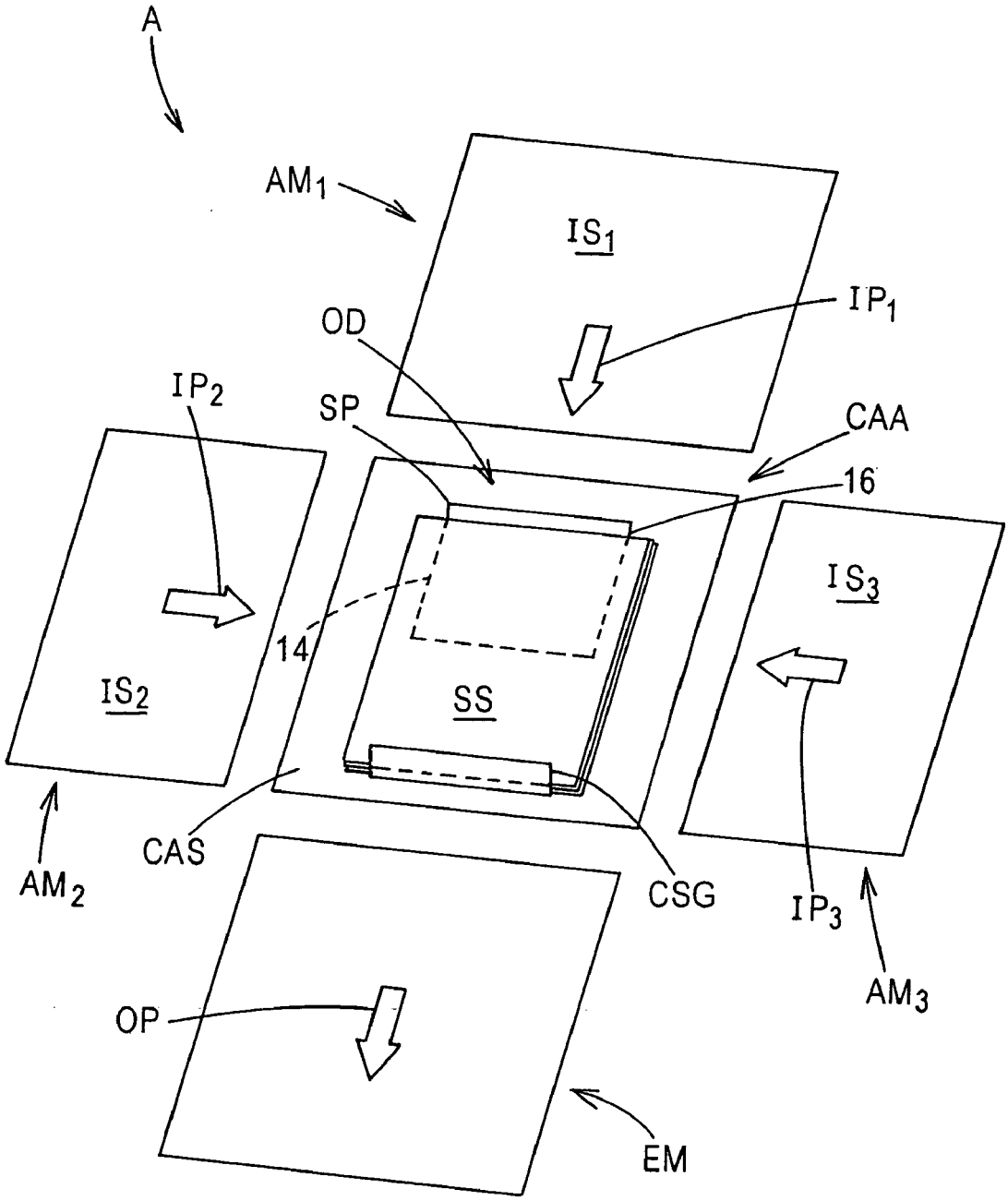
FIG. 2B is a schematic, top plan view of the apparatus and method disclosed herein, illustrating the result of assembling a sheet stack consisting of sheet articles supplied from multiple directions.
Figure 2C:
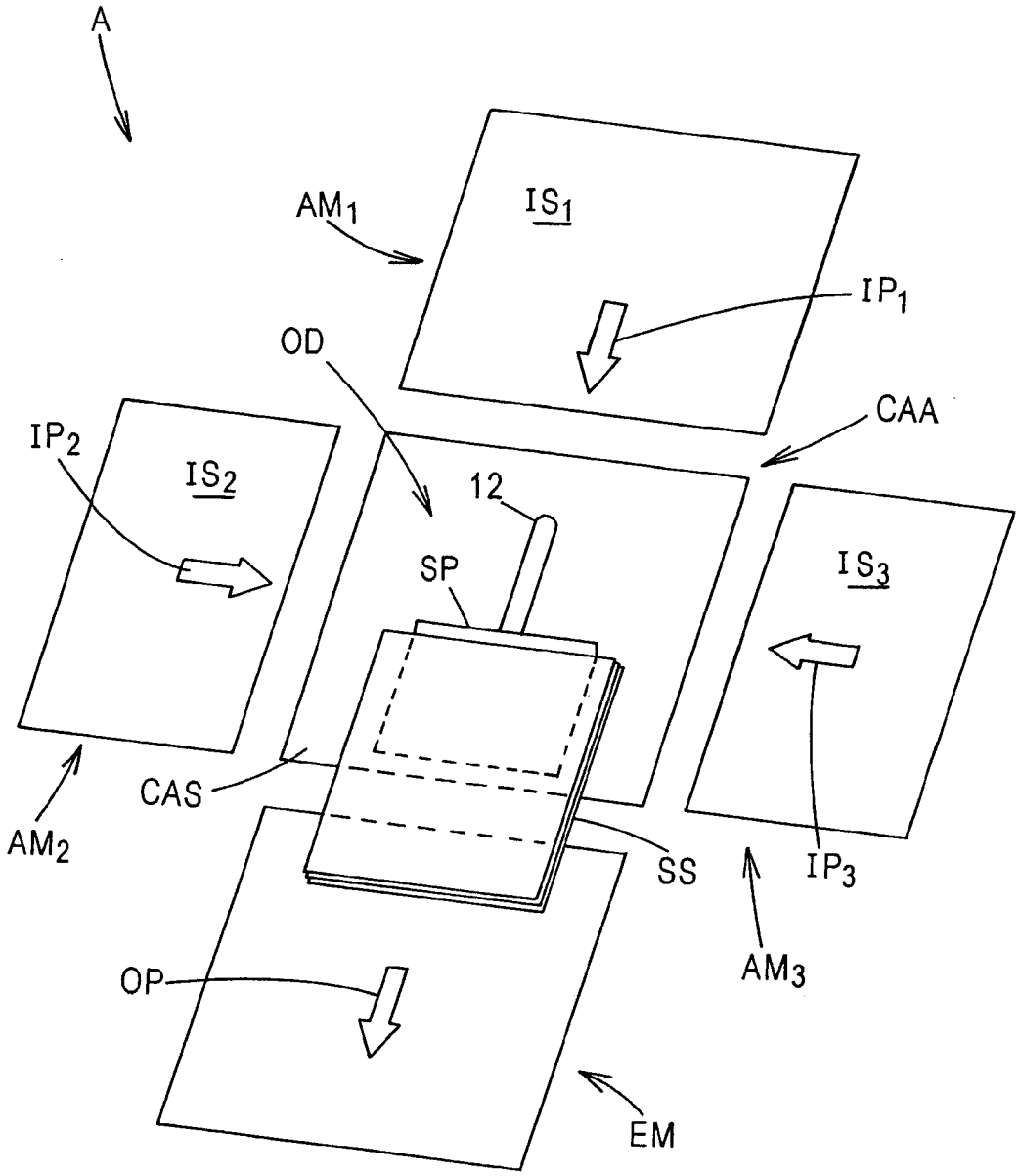
FIG. 2C is a schematic, top plan view of the apparatus and method disclosed herein, illustrating the assembled sheet stack being transported in an in-line downstream direction.

Referring now to FIGS. 2A, 2B and 2C, an example of the operation of assembling apparatus A is illustrated. As an initial matter, a job is defined in which a set of personalized booklets are to be constructed. Each booklet can include multiple types of sheet articles, such as for example a cover page (sheet article $S_3$) consisting of a single sheet article unit, a subset (sheet article $S_2$) of sheet article units, and a back page (sheet article $S_1$) consisting of a single sheet article unit. The cover pages of the booklets all contain the same printed material and/or graphics, except that each cover page is distinguished by personalized information such as the recipient's name, address, or the like. The subsets, in general, all contain the same type of detailed information, but the detailed information varies from one booklet to another depending on the recipient designated to receive that particular booklet. The back page can be the same for all booklets or, alternatively, the inside face of each back page can vary such as by containing a personalized summary of the accompanying detailed information contained in the corresponding subset. Hence, the exact content printed on sheet articles $S_1$, $S_2$ and $S_3$ of each booklet, as well as the exact number of pages, can vary from one booklet to another. By way of further example, assembling apparatus A is configured in cooperation with upstream sources such that each back page (sheet article $S_1$) is to be fed first into central accumulation area CAA from first input path $IP_1$, each subset of detailed information (sheet article $S_2$) is to be fed next into central accumulation area CAA from second input path $IP_2$, and each cover page (sheet article $S_3$) is to be fed last into central accumulation area CAA from third input path $IP_3$.

Referring to FIG. 2A, a suitable input source (i.e., one or more upstream devices UD as required as shown in FIG. 1) feeds sheet article $S_1$ along first input path $IP_1$ into first accumulator module $AM_1$. Another suitable input source feeds the units constituting sheet article $S_2$ along second input path $IP_2$ into second accumulator module $AM_2$. Second accumulator module $AM_2$ constructs the subset constituting sheet article $S_2$ by accumulating individual sheet article units as they are fed therein or, alternatively, receives a complete sheet article $S_2$ that has been previously accumulated by an upstream device. Yet another suitable input source feeds third sheet article $S_3$ along third input path $IP_3$ into third accumulator module $AM_3$. It will be noted that because each accumulator module $AM_1$, $AM_2$ and $AM_3$ is capable of staging its sheet article $S_1$, $S_2$ and $S_3$ prior to feeding it into central accumulation area CAA, the order in which sheet articles $S_1$, $S_2$ and $S_3$ or sheet article units are fed into accumulator modules $AM_1$, $AM_2$ and $AM_3$ does not matter, and the in-feed of sheet articles $S_1$, $S_2$ and $S_3$ into each accumulator module $AM_1$, $AM_2$ and $AM_3$ can be done simultaneously.

With continuing reference to FIG. 2A, after sheet article $S_1$ is received by first accumulator module $AM_1$ (and staged if necessary), first accumulator module $AM_1$ feeds sheet article $S_1$ into central accumulation area CAA along the direction of first input path $IP_1$. In some embodiments, longitudinal adjustment assembly LAA (see FIG. 1 and detailed description below) is advantageously capable of transporting sheet article $S_1$ in which case first accumulator module $AM_1$ hands sheet article $S_1$ off to longitudinal adjustment assembly LAA and longitudinal adjustment assembly LAA transports sheet article $S_1$ onto central accumulation surface CAS. Central accumulation area CAS includes a retractable central stop gate CSG, which preferably moves up from central accumulation surface CAS, to stop the movement of sheet article $S_1$ after being fed into central accumulation area CAA.

It will be noted in the present example that because sheet article $S_1$ consists of only a single sheet article unit, first accumulator module $AM_1$ does not perform the function of accumulating but instead serves only as an in-feed device. Hence, for this job, first accumulator module $AM_1$ could be removed and sheet article $S_1$ fed directly from another device of first input path $IP_1$ situated farther upstream of central accumulation area CAA. For other jobs, however, sheet article $S_1$ to be processed in first input path $IP_1$ can consist of a subset or plurality of sheet article units. Thus, the continued presence of first accumulator module $AM_1$ from one job to another will often be desirable so as to reduce set-up time between jobs. For some jobs, however, where a relatively large volume of sheet material is to be processed along first input path $IP_1$ and accumulation or staging of this sheet material is not needed, it might be desirable to remove first accumulator module $AM_1$ to eliminate an extra process step and thereby reduce in-process time for first input path $IP_1$.

With continuing reference to FIG. 2A, the accumulation capability of second accumulator module $AM_2$ eliminates the need for accumulation farther upstream of central accumulation area CAA. Individual sheet article units are fed into second accumulator module $AM_2$ and accumulated therein to form a subset constituting sheet article $S_2$. After the accumulation of sheet article $S_2$ is complete, second accumulator module $AM_2$ feeds sheet article $S_2$ into central accumulation area CAA along the direction of second input path $IP_2$, and sheet article $S_2$ comes to rest on top of previously fed sheet article $S_2$. The movement of sheet article $S_2$ in central accumulation area CAA is stopped by means of the structure of the interface between third accumulator module $AM_3$ and central accumulation area CAA, as described below.

After sheet articles $S_1$ and $S_2$ have been fed into central accumulation area CAA, third accumulator module $AM_3$ feeds sheet article $S_3$ into central accumulation area CAA along the direction of third input path $IP_3$, and sheet article $S_3$ comes to rest on top of previously fed sheet article $S_2$. The movement of sheet article $S_3$ in central accumulation area CAA is stopped by means of the structure of the interface between second accumulator module $AM_2$ and central accumulation area CAA, which can be identical in structure to the interface between third accumulator module $AM_3$ and central accumulation area CAA as described below.

FIG. 2B illustrates the result of the operations of the components of first, second and third input paths $IP_1$, $IP_2$ and $IP_3$. As shown in FIG. 2B, a document or sheet stack SS comprising sheet articles $S_1$, $S_2$ and $S_3$ has been assembled in central accumulation area CAA. As described in more detail below, central accumulation area CAA includes an output driving device, generally designated OD (see also FIG. 9), for transporting assembled sheet stack SS into exit module EM for further processing. Preferably, output driving device OD comprises a shuttle plate SP longitudinally translatable along central accumulation surface CAS by suitable motorized components. Shuttle plate SP communicates with such motorized components through an elongated slot 12 shown in FIG. 2C. Preferably, shuttle plate SP is L-shaped. Shuttle plate SP includes a first portion 14 on which sheet stack SS is at least partially disposed and an upright second portion 16 facing the trailing edge of sheet stack SS. Preferably, shuttle plate SP can be intermittently jogged (e.g., each time five sheet article units have been fed into central accumulation area CAA) so that the assembled sheet stack SS is longitudinally registered between second portion 16 of shuttle plate SP and central stop gate CSG in preparation for transfer to exit module EM. Moreover, the center pocket configuration of central accumulation area CAA described below causes side-to-side registration of sheet stack SS due to the lateral interfaces between central accumulation area CAA and second and third accumulator modules $AM_2$ and $AM_3$, respectively.

Finally, as shown in FIG. 2C, central stop gate CSG (shown in FIG. 2B) has retracted to allow shuttle plate SP to drive sheet stack SS into exit module EM along output path OP. Exit module EM then transports sheet stack SS along output path OP to downstream components for further processing, such as a device suitable for binding sheet stack SS to form a booklet.

It will be noted that, due to the three-input configuration of assembling apparatus A, the orientation in which sheet articles $S_1$, $S_2$ and $S_3$ are respectively fed from first, second and third input paths $IP_1$, $IP_2$ and $IP_3$ depends on the orientation in which the assembled sheet stack SS is to be fed to exit module EM. For example, if sheet stack SS is to be fed in portrait orientation, sheet article $S_1$ is likewise fed from first input path $IP_1$ in portrait orientation but sheet articles $S_2$ and $S_3$ are respectively fed from second and third input paths $IP_2$ and $IP_3$ in landscape orientation.

The exemplary process just described with reference to FIGS. 2A, 2B and 2C is repeated until all booklets required by the job have been constructed and transferred to output path OP.

Referring now to FIGS. 3 to 10B, the structure of assembling apparatus A will be described according to one embodiment. It will be noted that many structural and operational features that can be provided with assembling apparatus A—such as paper guides, structural members for providing a supporting framework for assembling apparatus A; features for mounting various components; motors; shafts; actuators; bearings; and the like—are not specifically described or illustrated herein because these features can be conventional and hence readily understood and appreciated by persons skilled in the art.

Figure 3:
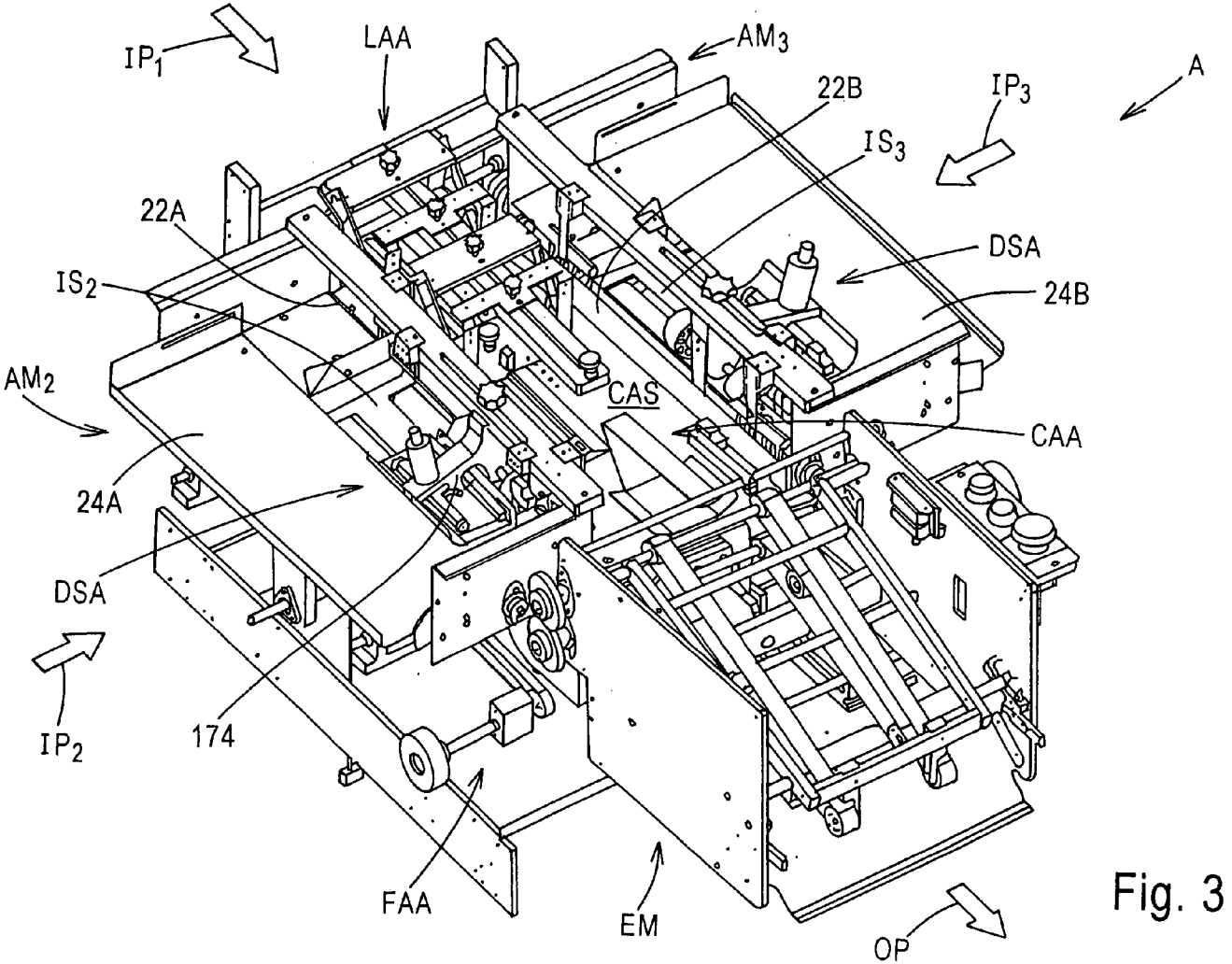
FIG. 3 is a perspective view of the apparatus for assembling a stack of sheet articles with opposing side accumulator modules and an exit module.
Figure 4A:
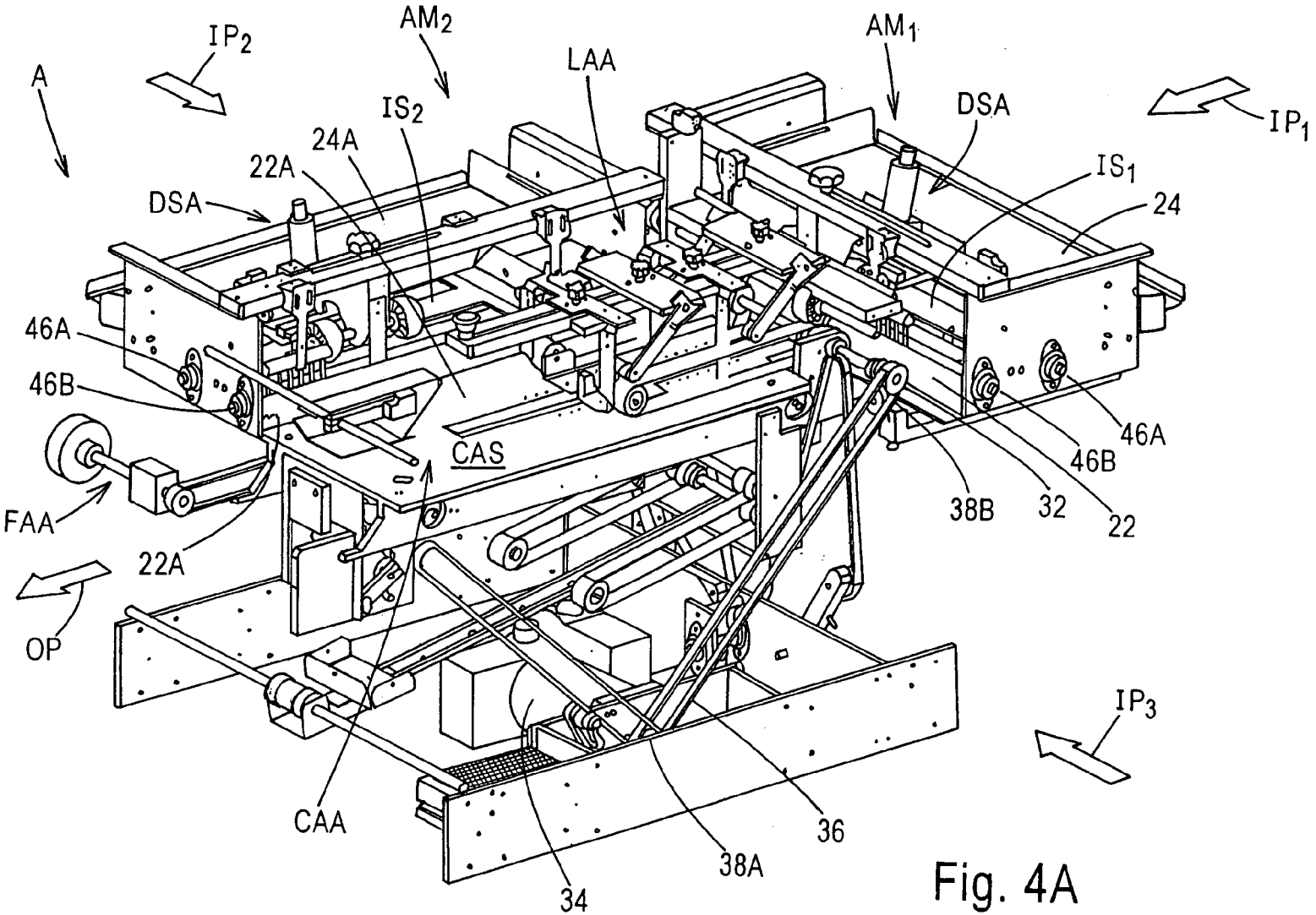
FIG. 4A is a perspective view of the apparatus for assembling a stack of sheet articles with one side accumulator module and an upstream in-line accumulator module.
Figure 4B:
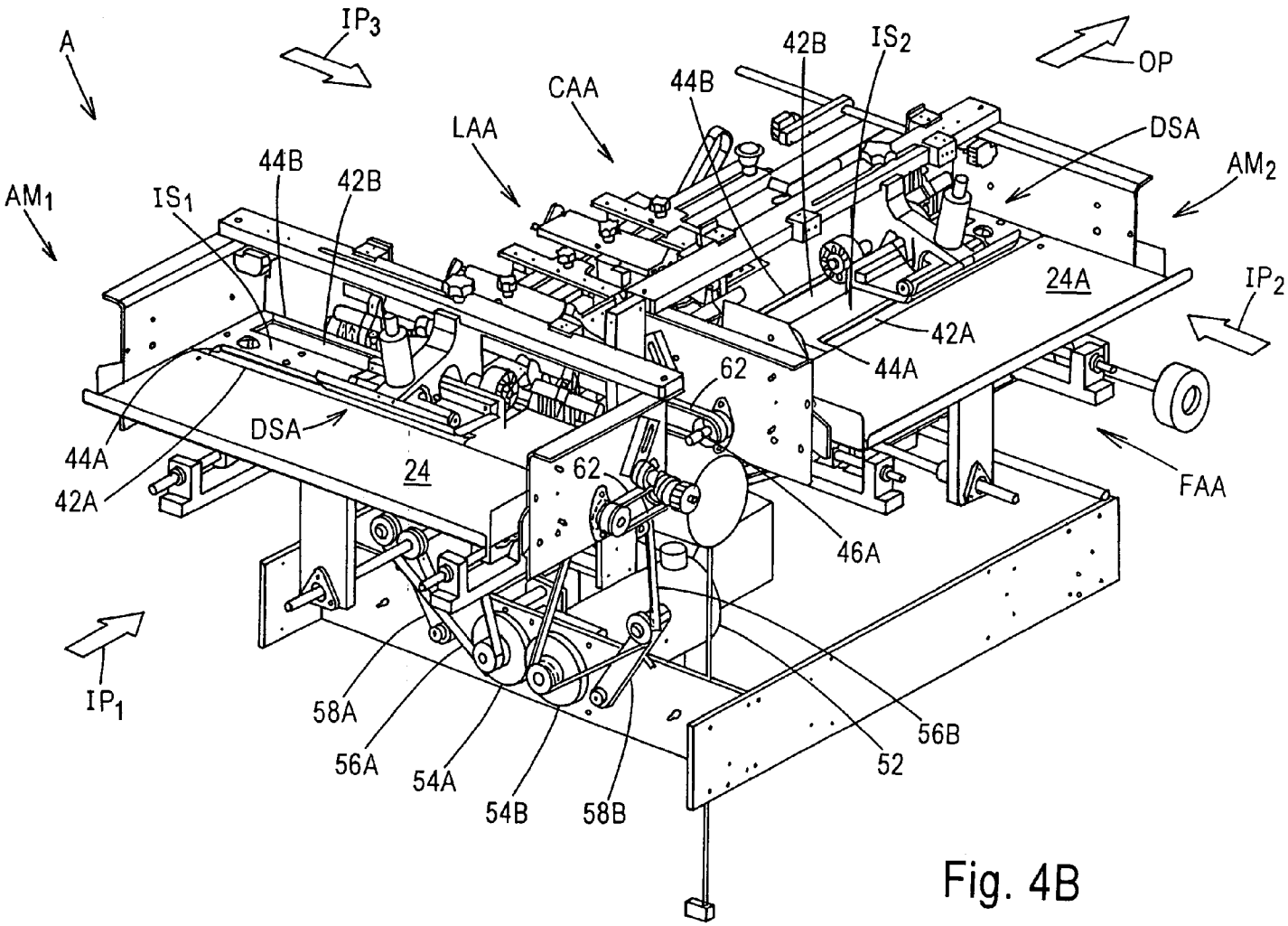
FIG. 4B is another perspective view of the apparatus for assembling a stack of sheet articles illustrated in FIG. 4A but rotated 180°.

FIG. 3 is a perspective view of assembling apparatus A in which first accumulator module $AM_1$ has been removed. FIGS. 4A and 4B are perspective views of assembling apparatus A in which first accumulator module $AM_1$ is installed in-line with assembling apparatus A, while third accumulator module $AM_3$ and exit module EM have been removed for clarity. Each accumulator module $AM_1$, $AM_2$ and $AM_3$ includes a respective input surface $IS_1$, $IS_2$ and $IS_3$ on which sheet articles are accumulated, staged, and fed onto central accumulation surface CAS. Each input surface $IS_1$, $IS_2$ and $IS_3$ is disposed at a higher elevation than central accumulation surface CAS. The physical transitions forming the interfaces between second and third accumulator modules $AM_2$ and $AM_3$ and central accumulation area CAA are defined by upright end walls 22A and 22B, respectively, which extend downwardly from the inside ends of second and third input surfaces $IS_2$ and $IS_3$ . Upright end wall 22A of second accumulator module $AM_2$ is best shown in FIG. 4A. Upright end walls $IS_1$ and $IS_2$, second portion 16 of shuttle plate SP (see, e.g., FIG. 5A), and central accumulation surface CAS can be considered as cooperatively defining a center pocket of central accumulation area CAA. Accordingly, the center pocket has a depth and is disposed below first, second and third input paths $IP_1$, $IP_2$ and $IP_3$, allowing sheet articles to be dumped from multiple directions onto a single central accumulation surface CAS at a single level. The formation of the center pocket in turn renders assembling apparatus A highly flexible in that sheet articles can be fed from multiple input paths in any desired order.

With continuing reference to FIGS. 3, 4A and 4B, each accumulator module AM includes a pivotable drive/stop assembly, generally designated DSA. Each drive/stop assembly DSA allows its corresponding accumulator module AM to alternately accumulate sheet articles from an upstream location and feed sheet articles into central accumulation area CAA on demand. Each side (second and third) accumulator module $AM_2$ and $AM_3$ also includes a frame adjustment assembly, generally designated FAA, for adjusting the lateral position of its corresponding accumulator module $AM_2$ and $AM_3$ relative to central accumulation area CAA to accommodate a change in form size of sheet articles to be processed. Each side accumulator module $AM_2$ and $AM_3$ further includes a respective laterally adjustable plate 24A and 24B for effectively modifying the lateral width of input surface $IS_1$ and $IS_2$, which also is for the purpose of accommodating a change in form size. Other features of LAA and exit module EM, are described in more detail below.

Referring to FIGS. 4A and 4B, if desired for complete modularity, the structure of first accumulator module $AM_1$ can be identical or substantially identical to that of second and third accumulator modules $AM_2$ and $AM_3$. However, in embodiments where longitudinal adjustment assembly LAA is provided, the use of frame adjustment assembly FAA and laterally adjustable plate 24 in first accumulator module $AM_1$ is not necessary. In the illustrated embodiment, unlike side accumulator modules $AM_2$ and $AM_3$ that feed their respective sheet articles into the center pocket of central accumulation area CAA, sheet articles from first input path $IP_1$ are first fed from first accumulator module $AM_1$ into longitudinal adjustment assembly LAA. Longitudinal adjustment assembly LAA in turn transports these sheet articles over the upstream section of central accumulation area CAA and feeds them into the center pocket. As shown in FIG. 4A, assembling apparatus A includes a drive system for driving an axle 32 of longitudinal adjustment assembly, comprising a suitable motor 34, one or more belts 36, and one or more pulleys 38A and 38B as appropriate.

As shown in FIGS. 3 and 4B, each accumulator module AM includes an upstream drive roller 42A and a downstream of drive roller 42B, which drive sheet articles toward central accumulation area CAA in a manner described below. Each drive roller 42A and 42B is disposed just below input surface IS and exposed through elongate openings 44A and 44B of input surface IS. Each pair of drive rollers 42A and 42B rotate on a corresponding pair of axles 46A and 46B (FIG. 4A). FIG. 4B illustrates an exemplary system for driving drive rollers 42A and 42B of each side accumulator module $AM_2$ and $AM_3$, which is generally mounted below the interface of first accumulator module $AM_1$ and central accumulation area CAA. This system includes a motor 52, a left gear 54A meshing with a right gear 54B with right gear 54B being driven directly by motor 52, a left upright belt 56A driven by the shaft of left gear 54A, a right upright belt 56B driven by the shaft of right gear 54B, a left tensioning device 58A for maintaining proper tension on left upright belt 56A, a right tensioning device 58B for maintaining proper tension on right upright belt 56B, and various pulleys (not specifically designated) as required. Each upright belt 56A and 56B drives one of the pair of drive roller axles 46A and 46B (see FIG. 4A) of each side accumulator module $AM_2$ and $AM_3$ (e.g., the axle closest to central accumulation area CAA, not visible in FIG. 4B), and a horizontally oriented belt 62 is used to transfer power to the other drive roller axle. Left and right tensioning devices 58A and 58B are adapted for maintaining tension in response to lateral adjustment of side accumulator modules $AM_2$ and $AM_3$ relative to central accumulation area CAA. A suitable system (not shown) for driving drive roller axles 46A and 46B and horizontally oriented belt 62 of first accumulator module $AM_1$ is also provided.

Figure 5A:
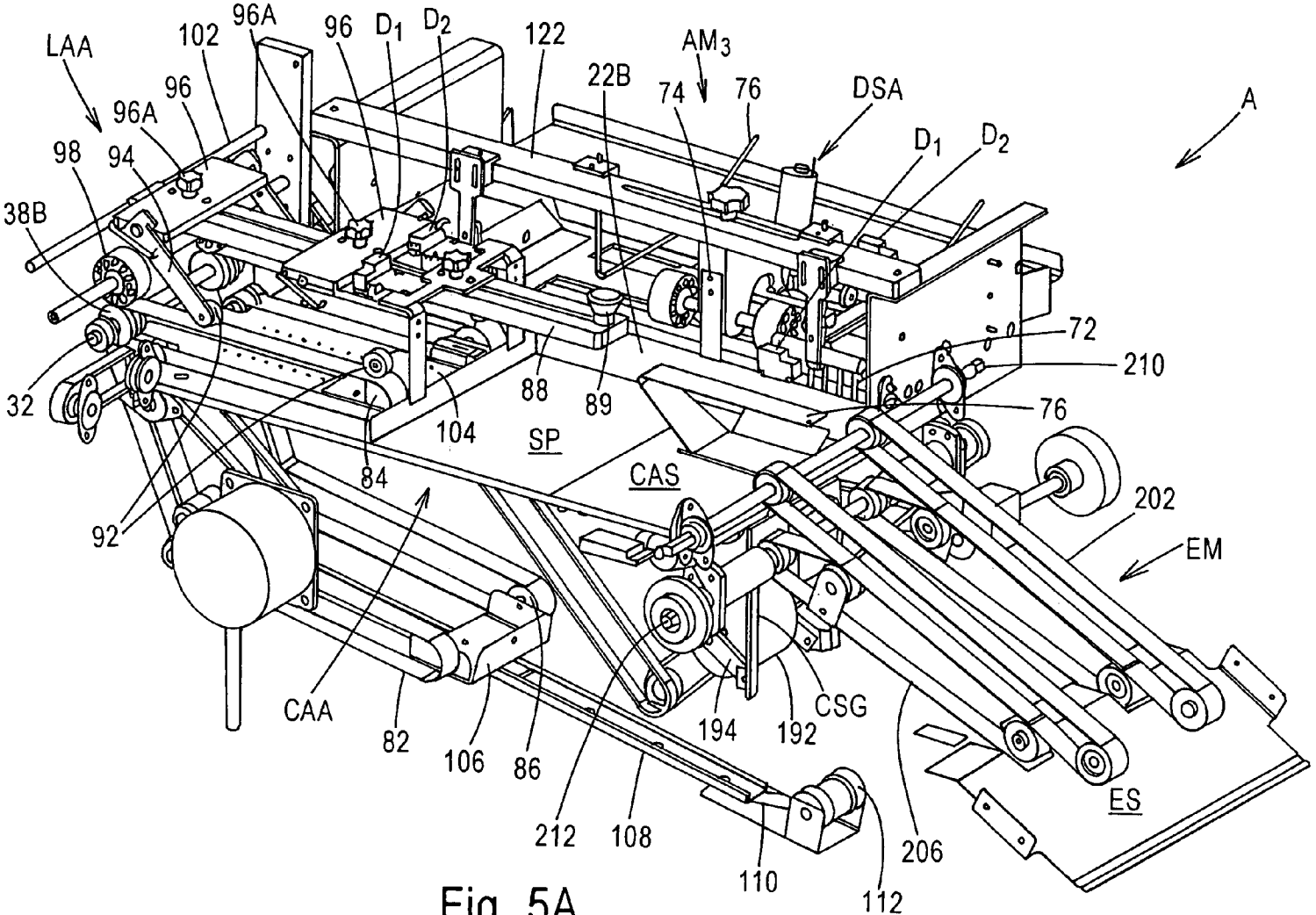
FIG. 5A is a perspective view of the apparatus for assembling a stack of sheet articles illustrating details of a longitudinal adjustment assembly and the exit module.

Referring to FIG. 5A, assembling apparatus A includes a number of different components that are appropriately mounted for the purpose of guiding sheet articles or maintaining their proper direction or orientation. Such components can include brushes 72, polymeric strips 74, suitably shaped rods 76 and plates 78, and the like. These components and their use are known to persons skilled in the art, and therefore will not be described further herein.

Figure 5B:
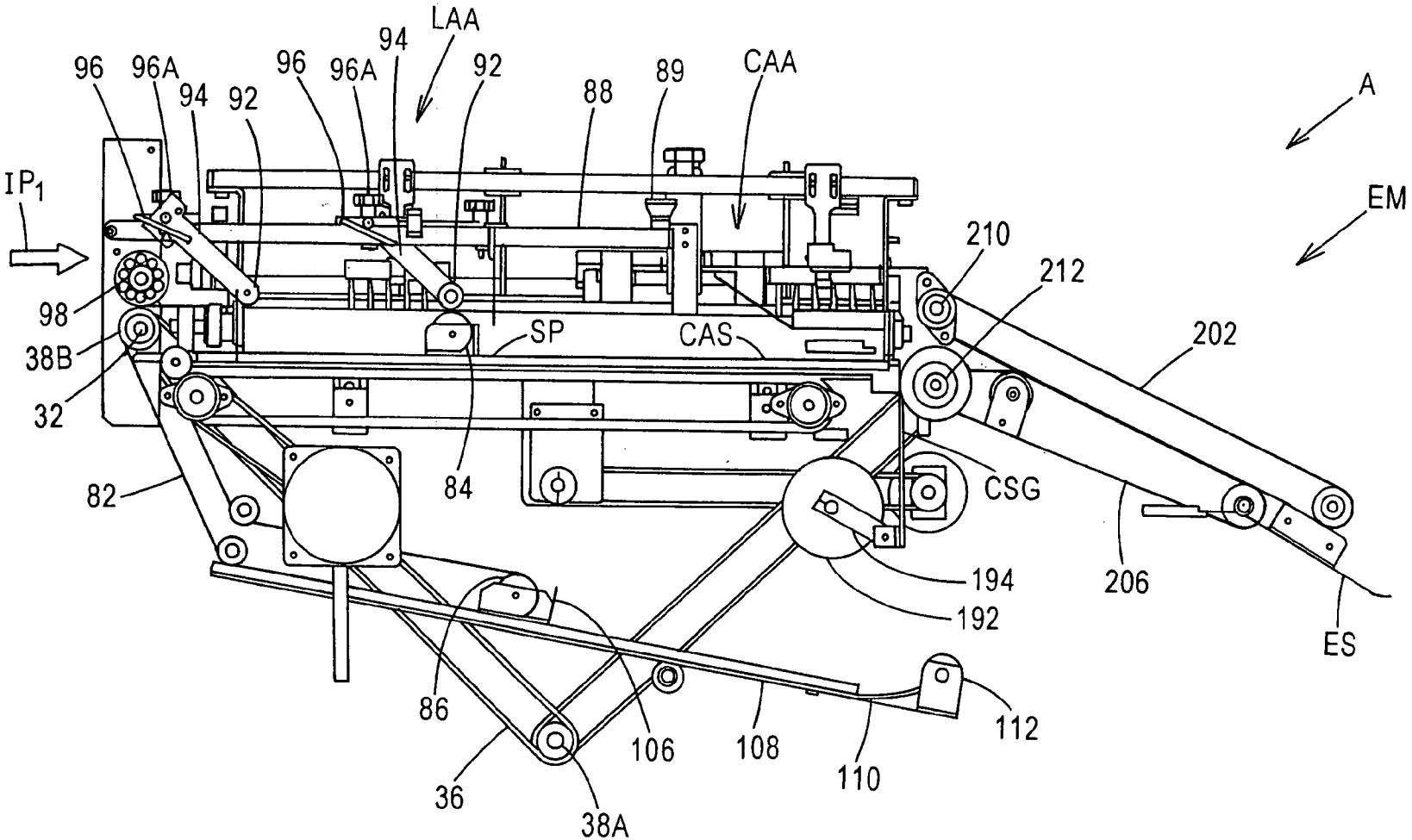
FIG. 5B is a side elevation view of the apparatus for assembling a stack of sheet articles, showing details of the longitudinal adjustment assembly and the exit module.

Referring to FIGS. 5A and 5B, longitudinal adjustment assembly LAA is in one embodiment provided in the form of a nose roller assembly. Longitudinal adjustment assembly LAA includes one or more drive belts 82 driven by pulleys 38B rotating with drive axle 32. Drive belts 82 are wrapped around upper nose rollers 84 situated in central accumulation area CAA and lower nose rollers 86 situated below central accumulation area CAA. A frame member 88 disposed above drive belts 82 supports one or more sets of passive nip rollers 92 biased toward drive belts 82 by bars 94. Each set of nip rollers 92 forms a nip with drive belts 82 for transporting sheet articles therebetween. To accommodate different form sizes, the longitudinal position of nip rollers 92 is adjustable by connecting bars 94 of nip rollers 92 with mounting assemblies 96 that are slidable along a slot of frame member 88. Mounting assemblies 96 include adjustment knobs 96A that can be tightened and loosened for this purpose. Mounting assemblies 96 are also removable from frame member 88 if necessary to accommodate larger form sizes. Sheet articles enter longitudinal adjustment assembly LAA from first input path $IP_1$, and from first accumulator module $AM_1$ (see FIGS. 4A and 4B) if provided, at a nip formed between drive pulleys 38B and input nip rollers 98. Input nip rollers 98 are preferably constructed from a resilient material. Frame member 88 is pivotally connected to other frame sections at a suitable transverse member 102 and includes a handle 89, thereby permitting nip rollers 92 to be pivoted away from drive belts 82 to permit access into the upstream region of central accumulation area CAA for maintenance, clearance of paper jams, or the like. As best shown in FIG. 5A, detection devices $D_1$ and $D_2$ can be mounted to frame member 88 for detection and/or counting of sheet articles transported through longitudinal adjustment assembly LAA.

Figure 6:
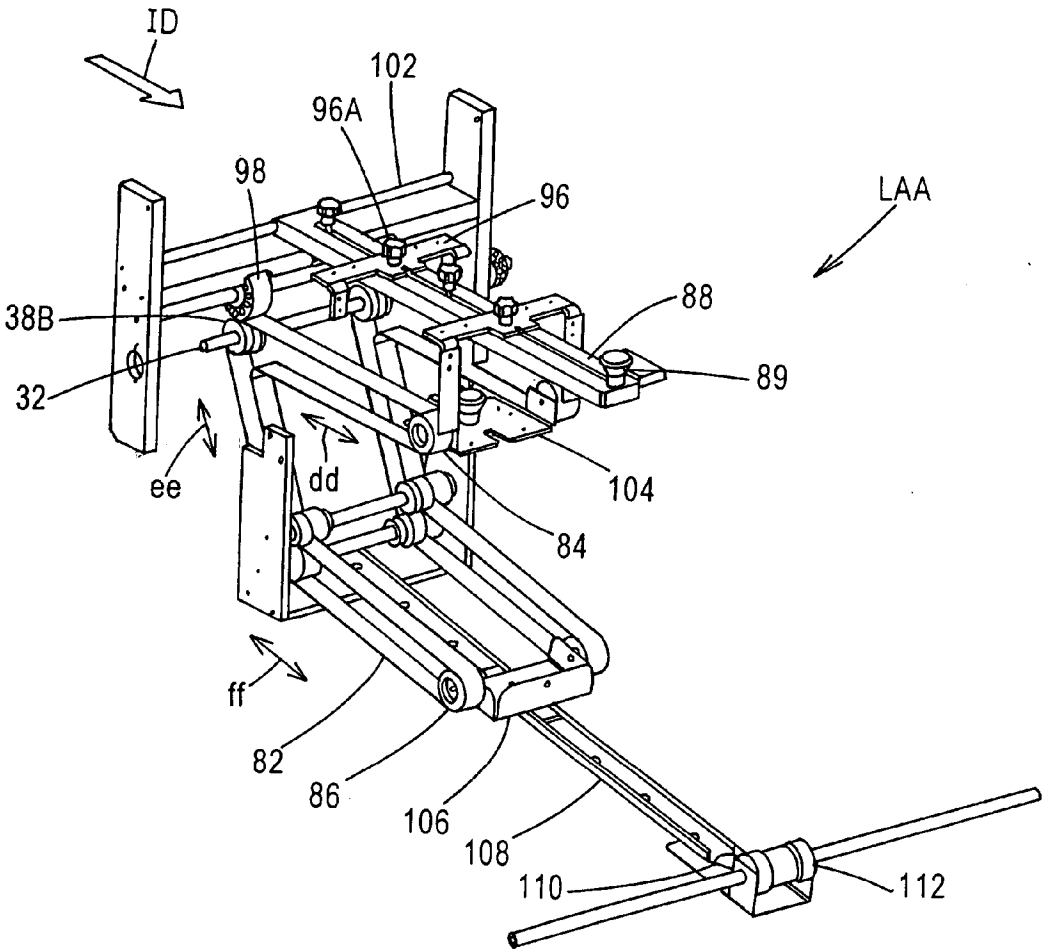
FIG. 6 is a perspective view of the longitudinal adjustment assembly provided with the apparatus for assembling a stack of sheet articles.

Referring additionally to FIG. 6, upper nose rollers 84 are mounted to an upper bracket 104 that is slidable along central accumulation surface CAS, and lower nose rollers 86 are mounted to a lower bracket 106 that is linearly slidable along a track 108. Manipulation of upper nose rollers 84 and/or lower nose rollers 86 causes the position of drive belts 82 to be shifted relative to central accumulation area CAA in accordance with arrows dd, ee and ff illustrated in FIG. 6. It can thus be seen, for example, that upper nose rollers 84 and drive belts 82 can be retracted in the upstream direction toward fixed-position drive pulleys 38B, thereby effectively increasing the longitudinal length of central accumulation surface CAS to accommodate larger form sizes. Shuttle plate SP (FIGS. 5A and 5B) can also be repositioned along central accumulation surface CAS to maintain a relatively abrupt transition from longitudinal adjustment assembly LAA to the center pocket of central accumulation area CAA. Tension in drive belts 82 is maintained at any position of upper nose rollers 84 and lower nose rollers 86 through the use of a constant force spring 110 coiled around a rotatable spool 112. One end of constant force spring 110 is attached to spool 112 and the other end is attached to lower bracket 106.

Referring back to FIGS. 5A and 5B, pivotable drive/stop assembly DSA provided with each accumulator module is longitudinally slidable along an upper frame member 122 of accumulator module AM, and includes an adjustment knob 124 that can be tightened and loosened for this purpose. In addition, each accumulator module AM can include the afore-mentioned detection devices $D_1$ and $D_2$ for detecting the presence and counting sheet articles processed in accumulator module AM, as best shown in FIG. 5A.

Figure 7A:
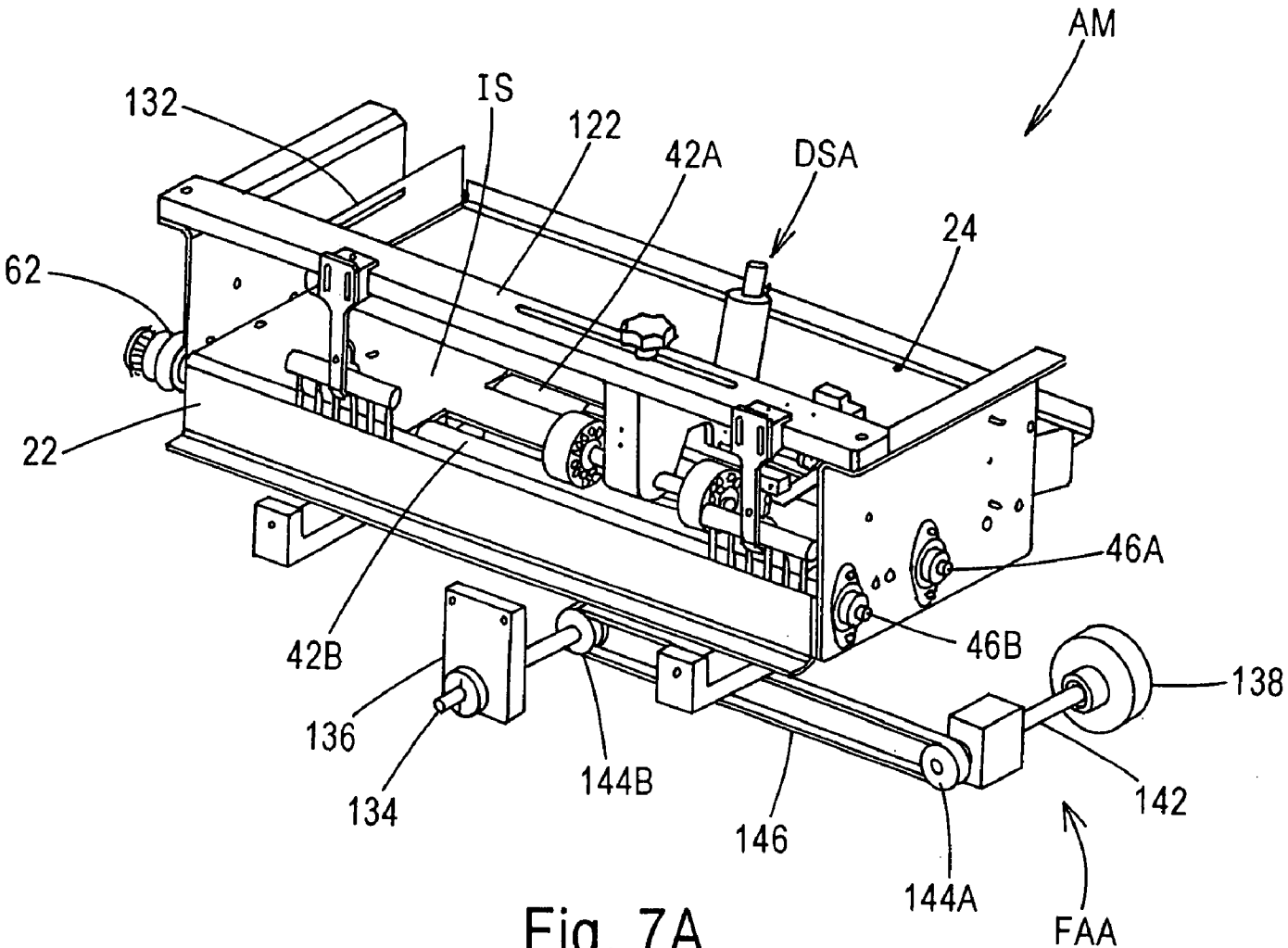
FIGS. 7A and 7B are detailed perspective views of an accumulator module provided with the apparatus for assembling a stack of sheet articles.
Figure 7B:
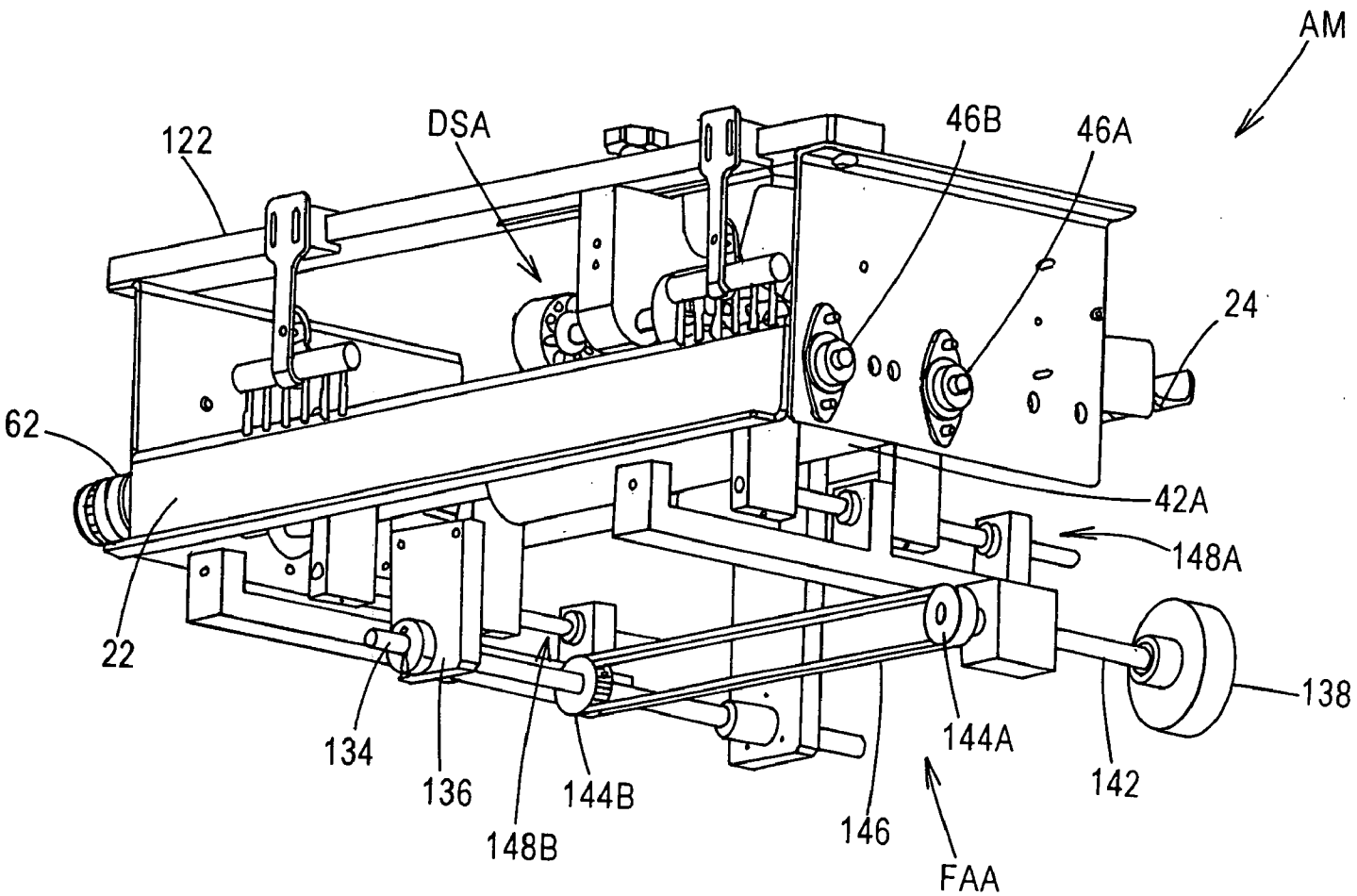
Figure 8:
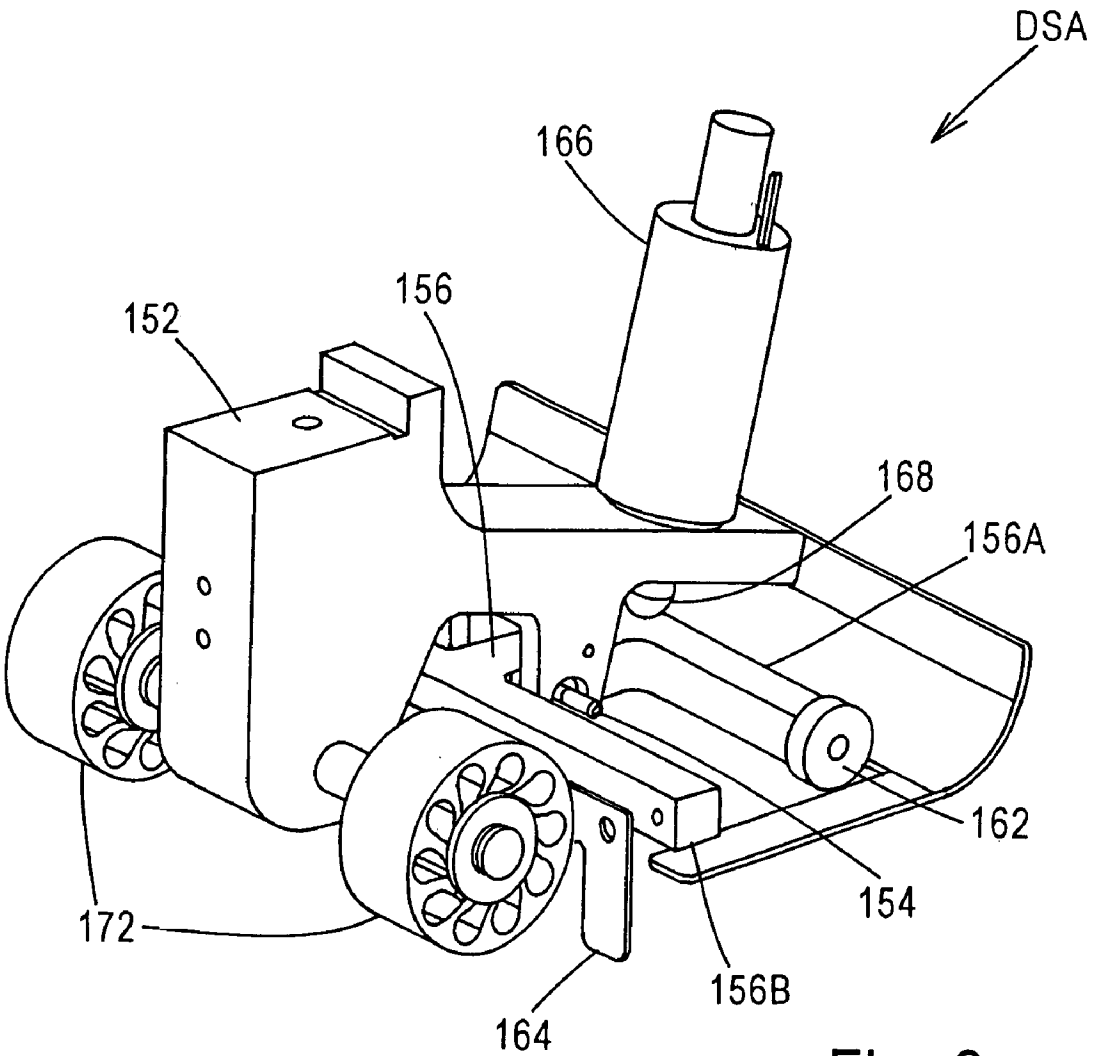
FIG. 8 is a detailed perspective view of a sheet article drive/stop assembly provided with the accumulator module of FIGS. 7A and 7B.

Referring now to FIGS. 7A, 7B and 8, additional details of each accumulator module AM are illustrated. As described earlier, each side accumulator module $AM_2$ and $AM_3$ is situated at the lateral sides of central accumulation area CAA (and optionally the in-line accumulator module $AM_1$) and can have two means for accommodating different form sizes. As shown in FIG. 7A, the first adjustment means is adjustment plate 24 that is slidable along input surface IS. The movement and fixation of adjustment plate 24 can be accomplished, for example, by providing one or more adjustment slots 132 and associated thumb screws (not shown). The second adjustment means is frame adjustment assembly FAA that is manipulated to adjust the lateral position of entire accumulator module AM relative to central accumulation area CAA. As best shown in FIG. 7B, frame adjustment assembly FAA includes a rotatable, fixed-position lead screw 134 threaded in a slide block 136. Rotation of lead screw 134 in one direction or the other causes slide block 136 to translate toward or away from central accumulation area CAA. Slide block 136 is attached to the main framework of accumulator module AM by conventional means not specifically shown, such that translation of slide block 136 likewise causes translation of accumulator module AM. Rotation of lead screw 134 is actuated manually by rotating an adjustment knob 138, although automated means could be provided as is appreciated by persons skilled in the art. Adjustment knob 138 is attached to a rotatable shaft 142. The rotation of adjustment knob 138 is transferred to lead screw 134 through an appropriate transmission assembly such as a pulley attached 144A to shaft 142, a pulley 144B attached to lead screw 134, and a belt 146 wrapped around pulleys 144A and 144B. The translation of accumulator module AM in this manner is supported and guided by suitable linear rod and bearing assemblies generally designated 148A and 148B.

Referring to FIG. 8, pivotable drive/stop assembly DSA of accumulator module AM comprises a main body 152 that supports a pivot pin 154 and a rocker arm 156 pivotable about the axis of pivot pin 154. The position of main body 152 is fixed during operation of drive/stop assembly DSA although, as previously described, the whole of drive/stop assembly DSA is longitudinally adjustable along upper frame member 122 (see FIG. 7A) to maintain alignment with the center pocket as the effective length of central accumulation surface CAA is adjusted. Rocker arm 156 includes a first portion 156A situated closest to the upstream end of accumulator module AM and a second portion 156B disposed on the opposite side of pivot pin 154. One or more passive, actuatable rollers 162 are attached to first portion 156A, and a stop gate 164 is attached to second portion 156B. It thus can be seen that during the course of pivoting rocker arm 156, stop gate 164 is in a down position when actuatable rollers 162 are in an up position and vice versa. A suitable actuator such as a solenoid 166 is mounted to main body 152 of drive/stop assembly DSA, and includes a reciprocating member 168 such as a plunger extending through a bore of main body 152 into contact with first portion 156A of rocker arm 156. Activation (or de-energizing) of solenoid 166 causes reciprocating member 168 to extend downwardly, thereby causing first portion 156A (and thus rollers 162) to rotate downwardly and second portion 156B (and thus stop gate 164) to rotate upwardly about pivot pin 154. Control signals can be sent to solenoid 166 from an electronic processing unit through a suitable electrical connection. Alternative actuation means could be used as appreciated by persons skilled in the art, such as an air cylinder communicating with a pneumatic circuit.

One or more passive nip rollers 172, preferably of the resilient type, are rotatably mounted to main body 152 of drive/stop assembly DSA. As evident in FIG. 7A, nip rollers 172 are situated above input surface IS of accumulator module AM, in close enough tolerance with downstream drive roller 42B to form a constant nip through which sheet articles are driven from accumulator module AM into central accumulation area CAA. Stop gate 164 and actuatable rollers 162, however, are positioned upstream of nip rollers 172, with actuatable rollers 162 being situated above input surface IS in operative alignment with upstream drive roller 42A. Stop gate 164 is biased in the downstream position by suitable means such as a spring 174 (see FIG. 3). When accumulator module AM is operating in its accumulation and/or staging mode, reciprocating member 168 of solenoid 166 is retracted so that stop gate 164 is in the down position and actuatable rollers 162 are in the up position. In this mode, incoming sheet articles are stopped and registered by stop gate 164 and cannot be driven by drive roller 42A that is situated below actuatable rollers 162. When, on the other hand, accumulator module AM is operating in its feeding mode, solenoid 166 is actuated to cause reciprocating member 168 to extend and bear down on first portion 156A of rocker arm 156, which in turn causes stop gate 164 to move to the up position and actuatable rollers 162 to move to the down position. In this mode, actuatable rollers 162 form a nip with their corresponding drive roller 42A to drive sheet articles under stop gate 164 to nip rollers 172 and their corresponding drive roller 42B, thereby allowing drive roller 42B to drive sheet articles into central accumulation area CAA.

Figure 9:
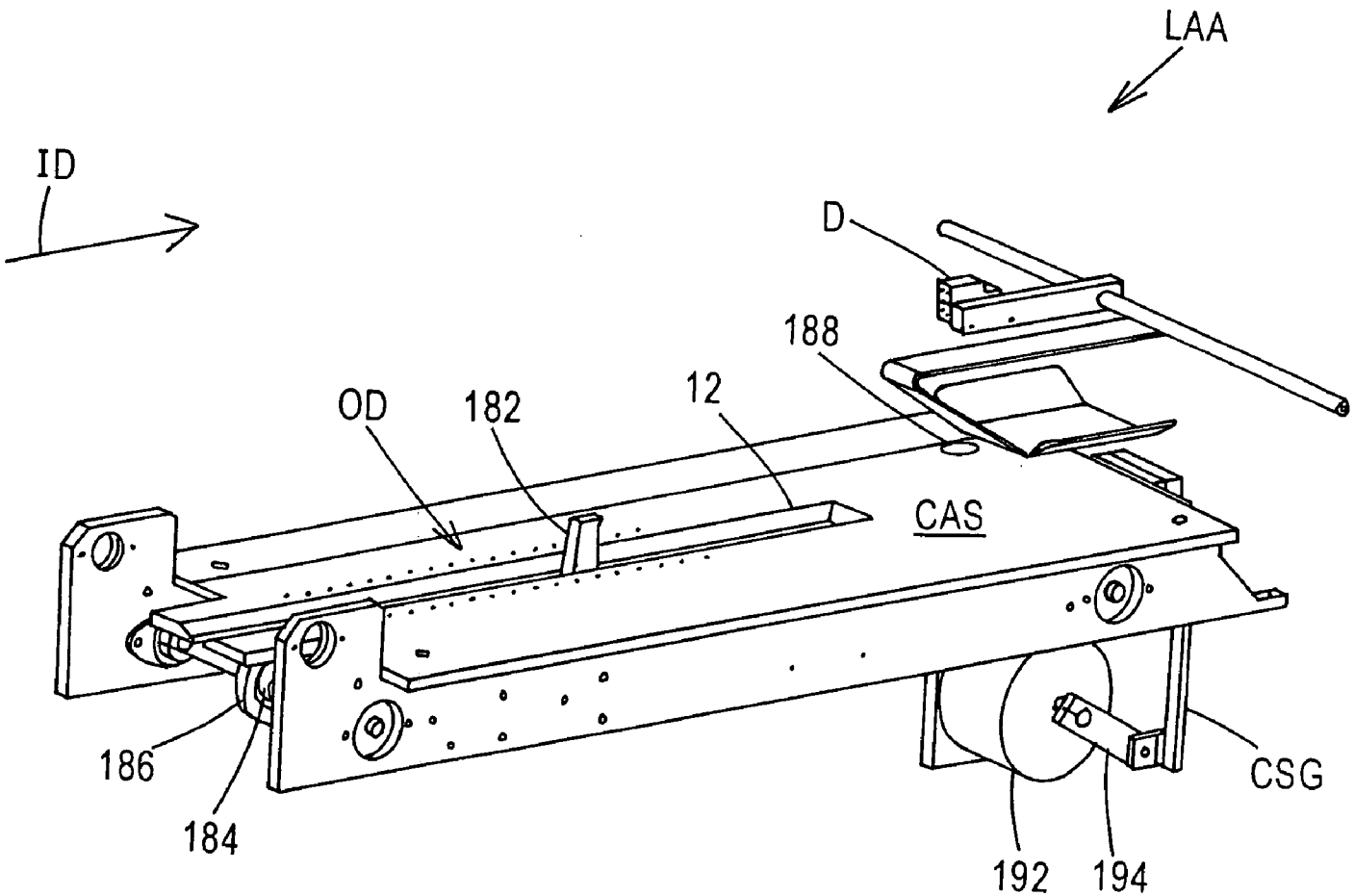
FIG. 9 is a perspective view of a central accumulation area of the apparatus for assembling a stack of sheet articles.

Referring now to FIG. 9, output driving device OD of central accumulation area CAA is further illustrated. In addition to shuttle plate SP described above and illustrated in FIGS. 5A and 5B, output driving device OD includes at least one pusher finger, such as for example single pusher finger 182 or other suitable member to which shuttle plate SP can be mounted. Pusher finger 182 moves through longitudinally oriented, elongate opening 12 of central accumulation surface CAS to drive a document, having been assembled from sheet articles fed from input paths IP, into exit module EM. Pusher finger 182 is actuated by any suitable drive system that, as is appreciated by persons skilled in the art, can include a motor (not shown) communicating with one or more pulleys 184 and a belt or a chain 186, all of which are preferably disposed below central accumulation surface CAA. FIG. 9 also illustrates a detection device D aligned over a reflective member 188 exposed through an aperture of central accumulation surface CAS. Like other detection devices associated with other locations of assembling apparatus A, one or more of these detection devices D can be used to detect the presence of sheet articles.

FIG. 9, as well as FIGS. 5A and 5B, further illustrates central stop gate CSG of central accumulation area CAA. Central stop gate CSG is illustrated in a down position at which it is retracted below the level of central accumulation surface CAS, at which position an assembled document is permitted to pass into exit module EM. Central stop gate CSG can be positioned adjacent to the downstream edge of central accumulation surface CAS, or can be extendable through a slot of central accumulation surface CAS. Central stop gate CSG is actuated by a rotary solenoid 192 through one or more pivotable arms 194. Activation (or deactivation) of rotary solenoid 192 causes arm 194 to pivot upward, thereby moving central stop gate CSG to an up position for registration of the leading edge of the document being assembled in central accumulation area CAA.

Figure 10A:
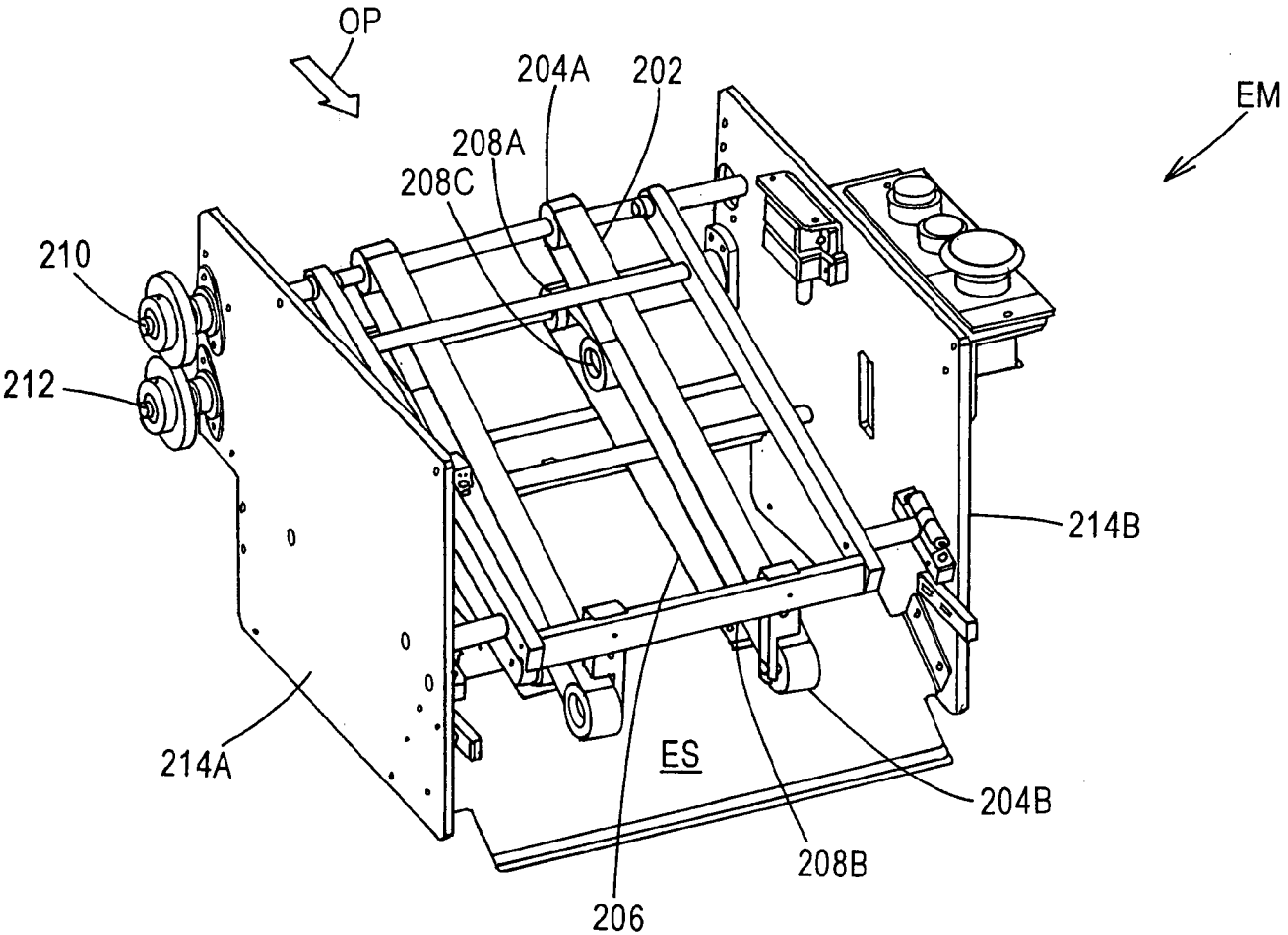
FIGS. 10A and 10B are perspective views of the exit module shown in alternative positions.
Figure 10B:
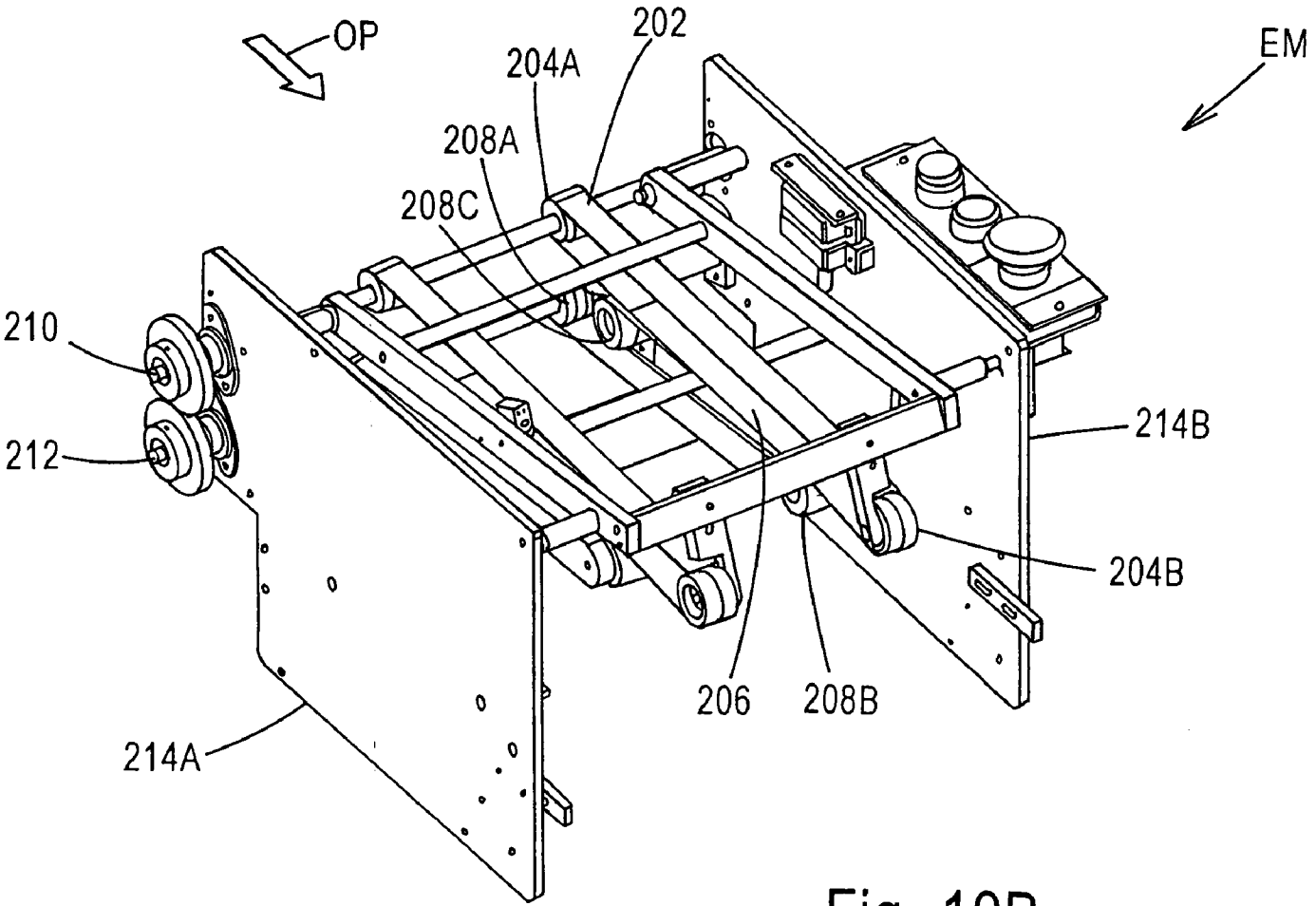

Referring now to FIGS. 10A and 10B (as well as FIGS. 5A and 5B), the structural details of exit module EM are illustrated. Specifically, FIG. 10A illustrates exit module EM in a down position and FIG. 10B illustrates exit module EM in an up position. The adjustability of exit module EM accommodates the use of different types of downstream devices, adding additional flexibility to assembling apparatus A. In the illustrated embodiment, exit module EM comprises one or more upper belts 202 wrapped around a suitable number of pulleys 204A and 204B, and one or more lower belts 206 wrapped around a suitable number of pulleys 208A, 208B and 208C. Upper and lower belts 202 and 206 are pivotable about respective upper and lower axles 210 and 212. Lower axle 212 is driven by a suitable drive system that can, if desired, share components with the drive system powering other assemblies of assembling apparatus A such as longitudinal adjustment assembly LAA. Assembled documents fed from central accumulation area CAA enter exit module EM between upper and lower belts 202 and 206, and are driven thereby onto an exit surface ES. Exit surface ES is not shown in FIG. 10B for clarity. Exit surface ES can be interfaced with any suitable downstream device (see, e.g., FIG. 1) for further processing of assembled documents. To accommodate various types of downstream devices, the elevation of assembled documents as they are discharged from exit module EM can by adjusted by pivoting upper belts 202, lower belts 206, and exit surface ES and re-affixing one or more of these components to side frames 214A and 214B of exit module EM in a conventional manner.

It will be understood that various details of the invention may be changed without departing from the scope of the invention. Furthermore, the foregoing description is for the purpose of illustration only, and not for the purpose of limitation, as the invention is defined by the claims as set forth hereinafter.

What is claimed is:

1. An apparatus for assembling a stack of sheet articles, the apparatus comprising:

(a) central accumulation area comprising a single-level accumulation surface for receiving and combining in a single stack sheet articles from at least two different directions;

(b) a plurality of individual sheet input paths for advancing sheet articles from the at least two different directions to the central accumulation area, one or more of the sheet input paths having an accumulator module adjacent to the central accumulation area, the accumulator module adapted to accumulate and/or stage one or more sheet articles prior to advancement of the sheet articles to the central accumulation area or to advance sheet articles to the central accumulation area without accumulating and/or staging the sheet articles;

(c) an output path for advancing an assembled single stack of two or more sheet articles from the central accumulation area as a sheet stack;

(d) a controller operatively connected with and controlling one or more of the individual sheet input oaths based upon predetermined information for assembling a stack of sheet articles in the central accumulation area, the controller being adapted for causing the accumulator module of the one or more individual sheet input oaths to accumulate and/or stage the sheet articles prior to advancement of sheet articles to the central accumulation area or to cause the accumulator module to advance the sheet articles to the central accumulation area at a predetermined time without accumulating and/or staging the sheet articles; and (e) wherein the plurality of individual sheet input paths comprises at least three sheet input paths.

2. An apparatus for assembling a stack of sheet articles, the apparatus comprising:

(a) a central accumulation area comprising a single-level accumulation surface for receiving and combining in a single stack sheet articles from at least two different directions;

(b) a plurality of individual sheet input oaths for advancing sheet articles from the at least two different directions to the central accumulation area, one or more of the sheet input oaths having an accumulator module adjacent to the central accumulation area, the accumulator module adapted to accumulate and/or stage one or more sheet articles prior to advancement of the sheet articles to the central accumulation area or to advance sheet articles to the central accumulation area without accumulating and/or staging the sheet articles;

(c) an output path for advancing an assembled single stack of two or more sheet articles from the central accumulation area as a sheet stack;

(d) a controller operatively connected with and controlling one or more of the individual sheet input oaths based upon predetermined information for assembling a stack of sheet articles in the central accumulation area, the controller being adapted for causing the accumulator module of the one or more individual sheet input paths to accumulate and/or stage the sheet articles prior to advancement of sheet articles to the central accumulation area or to cause the accumulator module to advance the sheet articles to the central accumulation area at a predetermined time without accumulating and/or staging the sheet articles; and (e) wherein at least first and second individual sheet input paths are configured to advance sheet articles into the central accumulation area from opposite sides of the central accumulation area.

3. The apparatus of claim 2 further comprising a third sheet input path configured to advance sheet articles into the central accumulation area substantially orthogonal to the first and second sheet input paths.

4. The apparatus of claim 2 comprising a first accumulator module adjacent to the central accumulation area and at least partially defining the first sheet input path and a second accumulator module adjacent to the central accumulation area and at least partially defining the second sheet input path, the first and second accumulator modules comprising respective first and second transport surfaces over which sheet articles are transported.

5. The apparatus of claim 4 wherein the central accumulation area comprises a central accumulation surface to which sheet articles are fed from the plurality of sheet input paths, the first and second transport surfaces are disposed at a higher elevation than the central accumulation surface, the first and second accumulator modules comprise respective first and second end walls extending downwardly from respective ends of the first and second transport surfaces toward the central accumulation surface, and the first and second end walls and the central accumulation surface cooperatively form a center pocket of the central accumulation area.

6. The apparatus of claim 5 wherein the transport surfaces and end walls of each of the first and second accumulator modules are laterally adjustable toward and away from the central accumulation surface for rendering a width of the center pocket adjustable.

7. An apparatus for assembling a stack of sheet articles, the apparatus comprising:

(a) a central accumulation area comprising a single-level accumulation surface for receiving and combining in a single stack sheet articles from at least two different directions;

(b) a plurality of individual sheet input paths for advancing sheet articles from the at least two different directions to the central accumulation area, one or more of the sheet input oaths having an accumulator module adjacent to the central accumulation area, the accumulator module adapted to accumulate and/or stage one or more sheet articles prior to advancement of the sheet articles to the central accumulation area or to advance sheet articles to the central accumulation area without accumulating and/or staging the sheet articles;

(c) an output oath for advancing an assembled single stack of two or more sheet articles from the central accumulation area as a sheet stack;

(d) a controller operatively connected with and controlling one or more of the individual sheet input paths based upon predetermined information for assembling a stack of sheet articles in the central accumulation area, the controller being adapted for causing the accumulator module of the one or more individual sheet input paths to accumulate and/or stage the sheet articles prior to advancement of sheet articles to the central accumulation area or to cause the accumulator module to advance the sheet articles to the central accumulation area at a predetermined time without accumulating and/or staging the sheet articles; and (e) wherein the accumulator module comprises a transport surface generally disposed at a higher elevation than the central accumulation area, a sheet feeding device for feeding sheet articles along the transport surface, and a stop gate alternately movable between a closed position at which sheet articles are prevented from being fed into the central accumulation area and an open position at which sheet articles are permitted to be fed into the central accumulation area.

8. The apparatus of claim 7 wherein the accumulator module comprises an actuator-driven rocker arm comprising a front portion, a rear portion and a rocker arm axis between the front and rear portions, the front and rear portions are pivotable about the rocker arm axis, and wherein the sheet feeding device of the accumulator module comprises a roller mounted to the rear portion and the stop gate is mounted to the front portion.

9. An apparatus for assembling a stack of sheet articles, the apparatus comprising:

(a) a central accumulation area comprising a single-level accumulation surface for receiving and combining in a single stack sheet articles from at least two different directions;

(b) a plurality of individual sheet input oaths for advancing sheet articles from the at least two different directions to the central accumulation area, one or more of the sheet input oaths having an accumulator module adjacent to the central accumulation area, the accumulator module adapted to accumulate and/or stage one or more sheet articles prior to advancement of the sheet articles to the central accumulation area or to advance sheet articles to the central accumulation area without accumulating and/or staging the sheet articles;

(c) an output oath for advancing an assembled single stack of two or more sheet articles from the central accumulation area as a sheet stack;

(d) a controller operatively connected with and controlling one or more of the individual sheet input paths based upon predetermined information for assembling a stack of sheet articles in the central accumulation area, the controller being adapted for causing the accumulator module of the one or more individual sheet input paths to accumulate and/or stage the sheet articles prior to advancement of sheet articles to the central accumulation area or to cause the accumulator module to advance the sheet articles to the central accumulation area at a predetermined time without accumulating and/or staging the sheet articles;

(e) wherein one of the sheet input paths is an in-line sheet input path oriented generally along the same direction as the output path to define an in-line path through the central accumulation area; and (f) wherein the central accumulation area comprises an upstream end interfacing with the in-line sheet input path, a downstream end interfacing with the output path, a center pocket terminating generally at the downstream end for receiving sheet articles from the sheet input paths, and a center pocket adjustment device movable toward and away from the upstream end for adjusting a longitudinal length of the center pocket.

10. The apparatus according to claim 9 wherein the center pocket adjustment device comprises a nose roller assembly.

11. An apparatus for assembling a stack of sheet articles, the apparatus comprising:

(a) a central accumulation area comprising a single-level accumulation surface for receiving and combining in a single stack sheet articles from at least two different directions;

a plurality of individual sheet input oaths for advancing sheet articles from the at least two different directions to the central accumulation area, one or more of the sheet input paths having an accumulator module adjacent to the central accumulation area, the accumulator module adapted to accumulate and/or stage one or more sheet articles prior to advancement of the sheet articles to the central accumulation area or to advance sheet articles to the central accumulation area without accumulating and/or staging the sheet articles;

(c) an output oath for advancing an assembled single stack of two or more sheet articles from the central accumulation area as a sheet stack;

(d) a controller operatively connected with and controlling one or more of the individual sheet input paths based upon predetermined information for assembling a stack of sheet articles in the central accumulation area, the controller being adapted for causing the accumulator module of the one or more individual sheet input oaths to accumulate and/or stage the sheet articles prior to advancement of sheet articles to the central accumulation area or to cause the accumulator module to advance the sheet articles to the central accumulation area at a predetermined time without accumulating and/or staging the sheet articles;

(e) wherein the central accumulation area comprises an output device for driving the assembled sheet stack into the output path; and (f) wherein the output device comprises a shuttle plate longitudinally movable along a surface of the central accumulation area, and the shuttle plate comprises a first section on which the sheet articles accumulate and a second section facing a trailing edge of the sheet articles.

12. An apparatus for assembling a stack of sheet articles, the apparatus comprising:

(a) a central accumulation area comprising a single-level accumulation surface for receiving and combining in a single stack sheet articles from at least two different directions;

(b) a plurality of individual sheet input oaths for advancing sheet articles from the at least two different directions to the central accumulation area, one or more of the sheet input paths having an accumulator module adjacent to the central accumulation area, the accumulator module adapted to accumulate and/or stage one or more sheet articles prior to advancement of the sheet articles to the central accumulation area or to advance sheet articles to the central accumulation area without accumulating and/or staging the sheet articles;

(c) an output Path for advancing an assembled single stack of two or more sheet articles from the central accumulation area as a sheet stack;

(d) a controller operatively connected with and controlling one or more of the individual sheet input oaths based upon predetermined information for assembling a stack of sheet articles in the central accumulation area, the controller being adapted for causing the accumulator module of the one or more individual sheet input paths to accumulate and/or stage the sheet articles prior to advancement of sheet articles to the central accumulation area or to cause the accumulator module to advance the sheet articles to the central accumulation area at a predetermined time without accumulating and/or staging the sheet articles;

(e) wherein the central accumulation area comprises an output device for driving the assembled sheet stack into the output path; and (f) wherein the central accumulation area comprises a stop gate movable between a closed position at which the sheet articles are prevented from being transported into the output path and an open position at which the assembled sheet stack is permitted to be transported into the output path.

13. The apparatus of claim 12 comprising means for jogging the output device to register the received sheet articles between at least a portion of the output device and the stop gate.

14. An apparatus for merging multiple sheet paths, the apparatus comprising:

(a) a central accumulation area for receiving and combining in a single stack one or more sheet articles from at least two different directions;

(b) a plurality of individual sheet input paths for advancing sheet articles from the at least two different directions to the central accumulation area, each sheet input oath having an accumulator module adjacent to the central accumulation area, the accumulator module adapted to accumulate and/or stage one or more sheet articles prior to advancement of the sheet articles to the central accumulation area or to advance sheet articles to the central accumulation area without accumulating and/or staging the sheet articles;

(c) an output oath for advancing an assembled single stack of two or more sheet articles from the central accumulation area as a sheet stack;

(d) a controller operatively connected with and controlling the individual sheet input paths based upon predetermined information for assembling a stack of sheet articles in the central accumulation area, the controller being adapted for selectively causing the accumulator module of each of the individual sheet input oaths to accumulate and/or stage sheet articles prior to advancement of sheet articles to the central accumulation area or to advance sheet articles to the central accumulation area at a predetermined time without accumulating and/or staging the sheet articles; and (e) wherein the accumulator module comprises a transport surface generally disposed at a higher elevation than the central accumulation area, a sheet feeding device for feeding sheets along the transport surface, and a stop gate alternately movable between a closed position at which sheets are prevented from being fed into the central accumulation area and an open position at which sheets are permitted to be fed into the central accumulation area.

15. The apparatus of claim 14 wherein the accumulator module comprises an actuator-driven rocker arm comprising a front portion, a rear portion and a rocker arm axis between the front and rear portions, the front and rear portions are pivotable about the rocker arm axis, and wherein the sheet feeding device of the accumulator module comprises a roller mounted to the rear portion and the stop gate is mounted to the front portion.

16. A method for merging multiple sheet paths, the method comprising the steps of:

(a) advancing one or more sheet articles along each of a plurality of individual sheet input paths from at least two different directions;

(b) based upon predetermined information for assembling a stack of sheet articles, selectively advancing the one or more sheet articles from each of the individual sheet input paths in a predetermined sequence into a central accumulation area or selectively accumulating and/or staging one or more of the sheet articles adjacent to the central accumulation area and then advancing the accumulated and/or staged sheet articles to the central accumulation area; and (c) accumulating and combining the sheet articles advanced from the individual sheet input paths into a single stack of two or more sheet articles in the central accumulation area and advancing the single stack of sheet articles out of the central accumulation area as a sheet stack into an output path.

17. The method of claim 16 wherein the plurality of individual sheet paths comprises at least three sheet paths.

18. The method of claim 17 wherein the three sheet paths advance sheet articles to the central accumulation area from different sides of the central accumulation area.

19. The method of claim 16 further comprising staging at least one or more of the sheet articles advanced by the plurality of individual sheet paths in a subset adjacent to the central accumulation area prior to advancing the one or more sheet articles to the central accumulation area.

20. The method of claim 16 comprising accumulating at least one or more of the sheet articles advanced by the plurality of individual sheet paths into a subset adjacent to the central accumulation area and advancing the subset into the central accumulation area.

21. The method of claim 16 further comprising registering at least one side of the accumulated sheet stack.

22. The method of claim 16 wherein the sheet stack accumulated in the central accumulation area is advanced therefrom to the output path in a direction which is substantially identical to the direction in which sheet articles are advanced to the central accumulation area from at least one of the plurality of sheet paths.

23. The method of claim 16 wherein advancing the sheet articles from each sheet path into the central accumulation area comprises transporting each sheet article from a higher elevation to a lower elevation.

24. The method of claim 16 comprising adjusting a longitudinal length of the central accumulation area by adjusting the position of a sheet in-feed device disposed at an upstream region of the central accumulation area.

25. The method of claim 16 comprising reading code data from one of more sheet articles of each sheet path prior to advancing the sheet articles into the central accumulation area.

26. The method of claim 25 comprising, for each sheet stack to be accumulated in the central accumulation area, advancing the sheet articles into the central accumulation area from each sheet path according to a sheet path order determined from the code data read from one or more sheet articles of one or more of the sheet paths.

27. The method of claim 25 comprising, for each sheet stack to be accumulated in the central accumulation area, advancing a specific number of sheet articles from each sheet path into the central accumulation area, wherein the number of sheet articles from each sheet path is determined from the code data read from at least one sheet article of each sheet path.

28. The method of claim 25 comprising, for each sheet stack to be accumulated in the central accumulation area, advancing a specific number of sheet articles from each sheet path into the central accumulation area, wherein the number of sheet articles from each sheet path is determined from the code data read from at least one sheet article of each sheet path, the code data comprising an end-of-subset character.

29. The method of claim 25 wherein reading code data determines whether the sheet articles of one or more of the sheet paths are to be accumulated into a subset prior to advancement into the central accumulation area.

30. A method of assembling a document, the method comprising:

(a) advancing one or more sheet articles along each of a plurality of sheet paths toward a central accumulation area from at least two different directions;

(b) reading code data printed on one or more of the sheet articles advanced along the plurality of sheet paths; and (c) assembling and combining sheet articles advanced from the plurality of sheet paths together into a predetermined stack of two or more sheet articles in the central accumulation area by advancing the sheet articles to the central accumulation area in a predetermined sequence based upon the read code data and by selectively accumulating and/or staging the sheet articles adjacent to the central accumulation area prior to advancement to the central accumulation area or selectively advancing the sheet articles to the central accumulation area without prior accumulation and/or staging of the sheet articles.

31. The method of claim 30 wherein sheet articles are advanced along at least three different sheet paths to the central accumulation area.

32. The method of claim 30 further comprising advancing the assembled stack of sheet articles from the central accumulation area.

33. An apparatus for assembling a stack of sheet articles, the apparatus comprising:

(a) a plurality of individual sheet input paths along which one or more sheet articles can be advanced;

(b) a central accumulation area comprising a single-level accumulation surface for receiving one or more sheet articles advanced from each individual sheet input path and from at least two different directions, and for assembling the sheet articles into a single stack of two or more sheet articles;

(c) an output path for advancing an assembled sheet stack of two or more sheet articles from the central accumulation area;

(d) at least one accumulator module for accumulating sheet articles of a corresponding sheet input path into a subset and feeding the subset to the central accumulation area;

(e) wherein the at least one accumulator module comprises a transport surface generally disposed at a higher elevation than the central accumulation area, a sheet feeding device for feeding sheet articles along the transport surface, and a stop gate alternately movable between a closed position at which sheet articles are prevented from being fed into the central accumulation area and an open position at which sheet articles are permitted to be fed into the central accumulation area; and (f) wherein the at least one accumulator module comprises an actuator-driven rocker arm comprising a front portion, a rear portion and a rocker arm axis between the front and rear portions, the front and rear portions are pivotable about the rocker arm axis, and wherein the sheet feeding device of the at least one accumulator module comprises a roller mounted to the rear portion and the stop gate is mounted to the front portion.

* * * * *